US008701823B2

(12) United States Patent
Matsushima et al.

(10) Patent No.: US 8,701,823 B2
(45) Date of Patent: Apr. 22, 2014

(54) EXHAUST SYSTEM FOR MOTORCYCLE

(75) Inventors: Satoshi Matsushima, Wako (JP); Yusuke Inoue, Wako (JP); Shiro Yama, Wako (JP); Seiichiro Eguchi, Wako (JP); Yosuke Inoue, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 49 days.

(21) Appl. No.: 13/355,097

(22) Filed: Jan. 20, 2012

(65) Prior Publication Data

US 2012/0205191 A1 Aug. 16, 2012

(30) Foreign Application Priority Data

Feb. 14, 2011 (JP) ..... 2011-028931
Feb. 14, 2011 (JP) ..... 2011-029188

(51) Int. Cl.

| | |
|---|---|
| ***F01N 1/00*** | (2006.01) |
| ***F01N 13/08*** | (2010.01) |
| ***B60K 13/04*** | (2006.01) |
| ***B62D 61/02*** | (2006.01) |
| ***B62K 11/00*** | (2013.01) |
| ***B62M 7/00*** | (2010.01) |

(52) U.S. Cl.
USPC ..... 181/227; 181/228; 181/254; 180/219; 180/296; 180/309; 60/323

(58) Field of Classification Search
USPC ..... 181/227, 228, 254; 180/219; 60/323
See application file for complete search history.

(56) References Cited

U.S. PATENT DOCUMENTS

| | | | | | |
|---|---|---|---|---|---|
| 3,949,829 | A * | 4/1976 | Honda et al. | ..... | 181/227 |
| 4,359,865 | A * | 11/1982 | Nakao et al. | ..... | 60/313 |
| RE31,989 | E * | 9/1985 | Nomura et al. | ..... | 180/219 |
| 5,271,477 | A * | 12/1993 | Gekka et al. | ..... | 180/219 |
| 5,966,933 | A * | 10/1999 | Ishihara et al. | ..... | 60/322 |
| 6,026,930 | A * | 2/2000 | Ogisu et al. | ..... | 181/228 |
| 6,675,933 | B2 * | 1/2004 | Yamaguchi | ..... | 181/227 |
| 6,752,239 | B2 * | 6/2004 | Misaki | ..... | 181/240 |
| 7,364,010 | B2 * | 4/2008 | Konno | ..... | 181/228 |
| 7,374,016 | B2 * | 5/2008 | Yamaguchi et al. | ..... | 181/249 |
| 7,637,349 | B2 * | 12/2009 | Harada | ..... | 181/265 |
| 8,359,847 | B2 * | 1/2013 | Hatchett | ..... | 60/324 |
| 2002/0175022 | A1 * | 11/2002 | Schumacher et al. | ..... | 181/254 |

(Continued)

FOREIGN PATENT DOCUMENTS

| | | | | |
|---|---|---|---|---|
| JP | 4-266579 | A | 9/1992 | |
| JP | 2003074337 | A * | 3/2003 | ..... F01N 7/04 |
| JP | 2005-313671 | A | 11/2005 | |

*Primary Examiner* — David Warren
*Assistant Examiner* — Christina Russell
(74) *Attorney, Agent, or Firm* — Birch, Stewart, Kolasch & Birch, LLP

(57) ABSTRACT

A muffler of a motorcycle having an outside diameter greater than the outside diameter d1 of a rectilinear portion of a branch pipe is disposed at a transverse portion of an exhaust pipe. Since the muffler is formed to be roughly elliptic in sectional shape, the outside diameter of the muffler is represented by a major diameter $d_a$ as the length in the direction of a major axis and a major diameter $d_b$ as the length in the direction of a minor axis. When the muffler is disposed between a swing arm and a seat to be along the transverse portion of the exhaust pipe, the muffler can be disposed on the more vehicle front side while securing the capacity thereof. Therefore, protrusion of the muffler toward the rear of the vehicle is suppressed, and the external appearance of a vehicle rear portion is enhanced.

20 Claims, 14 Drawing Sheets

(56) References Cited

U.S. PATENT DOCUMENTS

| | | | | |
|---|---|---|---|---|
| 2003/0079938 | A1* | 5/2003 | Yamaguchi | 181/227 |
| 2003/0121720 | A1* | 7/2003 | Chang | 181/254 |
| 2005/0224273 | A1* | 10/2005 | Conte | 180/309 |
| 2005/0236205 | A1* | 10/2005 | Konno | 180/219 |
| 2008/0110155 | A1* | 5/2008 | Harada | 60/276 |
| 2008/0251314 | A1* | 10/2008 | Mizutani | 181/251 |
| 2009/0236175 | A1* | 9/2009 | Inoue et al. | 181/255 |

* cited by examiner

EXHAUST SYSTEM FOR MOTORCYCLE

CROSS-REFERENCE TO RELATED APPLICATION

The present application claims priority under 35 U.S.C. §119 to Japanese Patent Application No. 2011-029188 and Japanese Patent Application No. 2011-028931, both filed Feb. 14, 2011, the entire contents of which are hereby incorporated by reference.

BACKGROUND OF THE INVENTION

1. Field of the Invention

The present invention relates to an improvement in an exhaust system and to the layout of a muffler for a motorcycle.

2. Description of Background Art

There have been known motorcycles to which a contrivance is applied to the layout of a muffler for various purposes (see, for example, Japanese Patent Laid-open No. Hei 4-266579 (FIG. 5)).

As shown in FIG. 5 of Japanese Patent Laid-open No. Hei 4-266579, a motorcycle (1) (the parenthesized numeral represents a reference symbol used in Japanese Patent Laid-open No. Hei 4-266579, here and below) has a configuration in which an engine (19) is mounted to a main frame (3), an exhaust pipe (46) is extended rearwardly downward from a cylinder head (27) of the engine (19), and a muffler (47) disposed on the lower side of a rear portion of the main frame (3) and a swing arm (15) is connected to a rear end portion of the exhaust pipe (46).

The muffler (47) is disposed on the lower side of the rear portion of the main frame (3) and the swing arm (15), and such a muffler layout is applicable, on a structural basis, to an off road motorcycle capable of traveling off-road. In an off road motorcycle, however, a sufficient vehicle height should be secured and, therefore, it is impossible to dispose a muffler at a lower portion of the vehicle body. Therefore, as described in Japanese Patent Laid-open No. Hei 9-254853, it has only been possible to dispose an exhaust pipe so as to protrude to the vehicle front side and to dispose a muffler on a vehicle lateral side. Such a configuration has problems in external appearance, an increase in vehicle width, etc.

When a muffler is disposed on a vehicle rear side or lateral side, the rear end of the muffler would protrudes to the vehicle rear side or a side portion of the muffler would protrude to a vehicle lateral side, leading to an increase in the size of the off road motorcycle. In addition, the external appearance may also be damaged.

There has been proposed an exhaust system for a motorcycle in which an exhaust pipe extending from an internal combustion engine is divided into a left part and a right part, and mufflers are provided respectively at tips of the left and right parts (see, for example, Japanese Patent Laid-open No. 2005-313671 (FIG. 3)).

As shown in FIG. 3 of Japanese Patent Laid-open No. 2005-313671, the exhaust system for a motorcycle has a configuration in which to a rear end of an exhaust pipe (50a) (the parenthesized numeral indicates a reference symbol used in Japanese Patent Laid-open No. 2005-313671, here and below) extending from an internal combustion engine toward the vehicle rear side, a branching section (55) is connected. From one part of the branching section (55) a first branch pipe (51) extends rearward, and a first muffler (31) is connected to the first branch pipe (51). From the other part of the branching section (55) a second branch pipe (52) extends toward a vehicle lateral side opposite to the side of the first branch pipe (51) through the rear side of a rear cushion (33), and a second muffler (32) is connected to the second branch pipe (52).

When further enhancement of silencing performance is demanded, it is necessary to take such a measure as increasing the muffler capacity of the mufflers (31, 32). An increase in the muffler capacity can be achieved by an increase in the diameter or an increase in the length of the mufflers (31, 32). When the length is increased, however, the mufflers (31, 32) may bulge to the vehicle rear side or may cause an increase in the vehicle width.

Restriction on vehicle length is greater in motorcycles than in four-wheel vehicles. Therefore, if the mufflers (31, 32) bulge to the vehicle rear side, the external appearance of the motorcycle may be damaged.

In addition, in motorcycles, mass concentration on the longitudinal center of the vehicle is desired. In this connection, bulging of the mufflers (31, 32) to the vehicle rear side makes it impossible or very difficult to achieve mass concentration.

Thus, there is a need for an exhaust system for a motorcycle that has a favorable external appearance and promises easy realization of mass concentration. Further, there is a need for a motorcycle in which a muffler can be installed in a smaller-sized form and the external appearance of a vehicle rear portion is enhanced.

SUMMARY AND OBJECTS OF THE INVENTION

It is an object of the present invention to provide a motorcycle in which a muffler can be installed in a smaller-sized form and the external appearance of a vehicle rear portion is enhanced.

According to an embodiment of the invention, a motorcycle includes: an engine supported on a vehicle body disposed between a front wheel and a rear wheel; a swing arm which is provided on the vehicle body, extends rearward and turnably supports the rear wheel on a rear end thereof; a seat disposed on the upper side of the rear wheel and supported by the vehicle body; and an exhaust pipe which extends from a cylinder head of the engine rearward on one of both lateral sides of the vehicle body and which, on the front side of the rear wheel, transverses from one of both lateral sides of the vehicle body to the other, with a transverse portion of the exhaust pipe passing between the swing arm and the seat, and the motorcycle is characterized in that a muffler having an outside diameter greater than the outside diameter of the exhaust pipe is disposed at the transverse portion of the exhaust pipe.

According to an embodiment of the invention, the vehicle body includes a head pipe, a main frame extending rearward from the head pipe, pivot plates extending downward from a rear end of the main frame, the swing arm swingably mounted on the pivot plate, seat rails disposed above a center point of swinging of the swing arm and supporting the seat, and a down tube extending downward from the head pipe and connected to the pivot plates; an air cleaner is disposed in a space under the seat rail; and the muffler is disposed in a space defined by a rear part of a shock absorber by which the main frame and the swing arm are interconnected, a lower part of the air cleaner, and an upper part of the swing arm.

According to an embodiment of the invention, rear portions of the pivot plates and the seat rails are interconnected by left and right rear pipes disposed in a left-right pair in a vehicle width direction; and a heat shield panel which shields heat tending to be transferred from the muffler to the air cleaner is provided so as to extend between the rear pipes and to pass between the air cleaner and the muffler.

According to an embodiment of the invention, side portions of the vehicle body are covered with side covers, and a rear number plate is disposed on a rear lower side of the side covers and on a lateral side of the muffler; and between the side covers and the rear number plate a cavity section is formed which extends in a back-and-forth direction of the vehicle body along the rear pipe.

According to an embodiment of the invention, at a lower edge portion of the side cover a rib is provided which extends toward the inside of the vehicle body and constitutes a member defining the cavity section, the rib being formed so as to close a gap between the rear pipe and the lower edge portion of the side cover; and at least a part of the rib is cut out to provide a cutout section, whereby a rib-side cavity is formed between the rib and the rear pipe.

According to an embodiment of the invention, an upper edge portion of the rear number plate is a part defining the cavity section, and is located proximate to the rear pipe while entering into the inner side of the vehicle body than the lower edge portion of the side cover.

According to an embodiment of the invention, a mud guard is mounted on the lower side of the air cleaner so as to cover the rear side of the muffler, and ear sections covering the heat shield panel are provided at upper portions of the mud guard.

According to an embodiment of the invention, the exhaust system includes an exhaust pipe which is connected to a front portion of a cylinder head of an internal combustion engine mounted to a vehicle body and extends on one of both lateral sides of the vehicle body toward a rear side of the vehicle body, an inner pipe which is connected to a rear portion of the exhaust pipe and has been subjected to punching for permitting an exhaust gas to flow therethrough, and a muffler which includes an outer tube covering the inner pipe and the rear portion of the exhaust pipe, and a sound absorbing material placed in the outer tube, is characterized in that: the exhaust pipe is branched at the rear portion thereof into a left part and a right part along a vehicle width direction on the rear side of a shock absorber provided on the vehicle body, and includes a first branch pipe extending to one of both lateral sides of the vehicle body, and a second branch pipe extending to the other of both lateral sides of the vehicle body by passing between the shock absorber and a rear wheel connected to the shock absorber; the inner pipe includes a first inner pipe connected to the first branch pipe, and a second inner pipe connected to the second branch pipe; and the outer tube is formed so as to integrally cover a part ranging from a front-side pipe portion disposed forwardly of a branching section of the exhaust pipe rear portion to the branching section, the first branch pipe and the first inner pipe, the second branch pipe and the second inner pipe, which are disposed rearwardly of the front-side pipe portion, in a U shape in plan view.

According to an embodiment of the invention, front-side punching sections permitting the exhaust gas to pass therethrough are added to a rectilinear portion of the first branch pipe and a rectilinear portion of the second branch pipe, whereas the front-side punching sections are not added to either a curved portion of the first branch pipe or a curved portion of the second branch pipe.

According to an embodiment of the invention, the second branch pipe and the second inner pipe are formed to be greater in diameter than the first branch pipe and the first inner pipe.

According to an embodiment of the invention, the outer tube includes a first outer cylinder by which the front-side pipe portion and the branching section and the first branch pipe and the second branch pipe are covered, and a pair of left and right second outer tubes which are detachably attached to the first outer tube and by which the first inner pipe and the second inner pipe are covered, and the first outer tube is provided thereon with a maintenance lid which covers the front-side punching section disposed at the rectilinear portion of the second branch pipe.

According to an embodiment of the invention, the first branch pipe and the first inner pipe are gradually decreased in diameter as a first exhaust port forming a rear end of the first inner pipe is approached, and the second branch pipe and the second inner pipe are gradually decreased in diameter as a second exhaust port forming a rear end of the second inner pipe is approached.

According to an embodiment of the invention, rear-side punching sections located rearwardly of the front-side punching sections and permitting the exhaust gas to pass therethrough are added to the first inner pipe and the second inner pipe, and the hole diameter in the front-side punching section is smaller than the hole diameter in the rear-side punching section.

According to an embodiment of the invention, the first outer tube is formed in a flat shape in side view, and an upper surface portion and a lower surface portion of the first outer tube are formed to be inclined rearwardly upward.

According to an embodiment of the invention, the first branch pipe and the second branch pipe are each bent in an S shape in side view and then obliquely extended rearwardly upward.

Effects of the Invention include the following:

According to an embodiment of the invention, the exhaust pipe is so disposed as to extend from the cylinder head of the engine rearward on one of both lateral sides of the vehicle body and to transverse, on the front side of the rear wheel, from one of both lateral sides of the vehicle body to the other. In addition, the transverse portion of the exhaust pipe is so disposed as to pass between the swing arm and the seat, and the muffler having an outside diameter greater than the outside diameter of the exhaust pipe is disposed at such a transverse portion. When the exhaust pipe is disposed between the swing arm and the seat to be along the transverse portion of the exhaust pipe, the muffler can be disposed on the more forward side while securing the capacity thereof. Therefore, protrusion of the muffler to the vehicle rear side can be suppressed. In other words, the motorcycle can be provided with the muffler in a smaller-sized form. In addition, when the protrusion of the muffler to the vehicle rear side is suppressed, the external appearance of a vehicle rear portion can be enhanced. Accordingly, it is possible to provide a motorcycle in which a muffler can be installed in a smaller-sized form and the external appearance of a vehicle rear portion is enhanced.

According to an embodiment of the invention, the muffler is disposed in the space defined by a rear part of the shock absorber by which the main frame and the swing arm are interconnected, a lower part of the air cleaner, and an upper part of the swing arm. This space is an empty part present in the motorcycle, and by disposing the muffler in this empty part it is possible to dispose the muffler on the motorcycle in a small-sized form.

According to an embodiment of the invention, the heat shield panel extending between the left and right rear pipes is provided between the air cleaner and the muffler. Therefore, the heat of the muffler is transferred via the heat shield panel to the left and right rear pipes. Since the heat of the muffler is unlikely to be transferred to the air cleaner, the temperature of the air cleaner itself can be prevented from being raised.

According to an embodiment of the invention, the cavity section extending in the back-and-forth direction of the vehicle body so as to be along the rear pipes is formed between the side cover and the rear number plate. When the cavity section is formed between the side cover and the rear number plate, it becomes easier to introduce the airflow (induced by the traveling of the vehicle) from the outside to the inside of the vehicle body through the cavity section. Consequently, air can be stably supplied to the air cleaner.

According to an embodiment of the invention, the rib extending into the inside of the vehicle body and defining the cavity section is provided at the lower edge portion of the side cover, in such a manner that the gap between the rear pipe and the lower edge portion of the side cover is closed with the rib. In addition, at least a part of the rib is cut out to provide the cutout section, so that the rib-side cavity is formed between the rib and the rear pipe. When the rib-side cavity is provided between the rib and the rear pipe in addition to the cavity section, the airflow can be introduced through the cavity section and the rib-side cavity to the inside of the vehicle body more assuredly, so that the air cleaner can be supplied with air more stably.

According to an embodiment of the invention, the upper edge portion of the rear number plate is a part defining the cavity section and is located proximate to the rear pipe while entering the inner side of the vehicle body than the lower edge portion of the side cover. When the upper edge portion of the rear number plate is located proximate to the rear pipe, the waste heat of the muffler is prevented from making contact with the airflow introduced to the inside of the vehicle body, so that the temperature of air supplied to the air cleaner can be prevented from being raised.

According to an embodiment of the invention, the mud guard is mounted on the lower side of the air cleaner so as to cover the rear side of the muffler, and ear sections covering the heat shield panel in rear view are provided at upper portions of the mud guard. The ear sections can prevent mud from splashing onto the heat shield panel, so that heat shielding performance of the heat shield panel can be maintained.

According to an embodiment of the invention, the outer tube is formed to integrally cover the part ranging from the front-side pipe portion disposed forwardly of the branching section of the exhaust pipe rear portion to the branching section, the first branch pipe and the first inner pipe, the second branch pipe and the second inner pipe, which are disposed rearwardly of the front-side pipe portion, in a U shape in plan view. In other words, the exhaust pipe rear portion also has a muffler structure. The front end of the outer tube that corresponds to an outer shell of a muffler is disposed forwardly of the branching section, where two branch pipes are branched, by utilizing a dead space. Therefore, the exhaust system can be disposed on the more vehicle front side while increasing the capacity of the muffler. Consequently, an exhaust system for a motorcycle is provided which has a favorable external appearance and promises easy realization of mass concentration.

According to an embodiment of the invention, the front-side punching sections are added to, the rectilinear portion of the first branch pipe and the rectilinear portion of the second branch, whereas the front-side punching sections are not added to either the curved portion of the first branch pipe or the curved portion of the second branch pipe. In the curved portion, unevenness of exhaust flow is generated due to a centrifugal force or the like at the time of passage of the exhaust gas. Since the front-side punching section is not disposed in the part where such an unevenness is generated, the sound pressure can be evenly diffused into the sound absorbing material.

According to an embodiment of the invention, the second branch pipe and the second inner pipe are formed to be greater in diameter than the first branch pipe and the first inner pipe. In addition, the second branch pipe extends between the shock absorber and the rear wheel, which is connected to the shock absorber, to the vehicle lateral side opposite to the side where the first branch pipe is disposed; therefore, the length of the second branch pipe is greater than the length of the first branch pipe. The second branch pipe and the second inner pipe comparatively greater in flow path length are formed to be larger in diameter, whereby the flow rate of an exhaust gas flowing through the second branch pipe and the second inner pipe is increased. Consequently, it is ensured that the exhaust gas flows though the left and right branch pipes and inner pipes in a well-balanced manner.

According to an embodiment of the invention, the outer tube includes the first outer tube, and the pair of left and right second outer tubes. The second outer tubes are detachably attached to the first outer tube. Since the attachment of the second outer tubes to the first outer tube is tube-to-tube mounting, the assemblage of the outer tube is easy to carry out.

In addition, the first outer tube is provided thereon with the maintenance lid which covers the front-side punching section disposed at the rectilinear portion of the second branch pipe. Since the second branch pipe is a pipe passing between the shock absorber and the rear wheel, the rectilinear portion of the second branch pipe is disposed in the vicinity of the center of the first outer tube. In other words, the maintenance lid is provided in the vicinity of the center of the first outer tube and, therefore, the sound absorbing material may be easily placed in the first outer tube. Accordingly, it is possible to provide an exhaust system which is easy to mount.

According to an embodiment of the invention, the first branch pipe and the first inner pipe are gradually decreased in diameter as the first exhaust port is approached, and the second branch pipe and the second inner pipe are gradually decreased in diameter as the second exhaust port is approached. Thus, passage resistance is raised gradually as the exhaust port is approached, whereby an exhaust pressure is diffused to the sides of the sound absorbing materials and release of exhaust gas can be secured. Since the acoustic energy of the exhaust can be absorbed into the sound absorbing materials, a silencing effect is enhanced.

According to an embodiment of the invention, the hole diameter in the front-side punching section is smaller than the hole diameter in the rear-side punching section. When the exhaust gas the front-side punching section, the acoustic energy of the exhaust is absorbed, so that a silencing effect is exhibited. In addition, with the hole diameter in the front-side punching section set smaller than the hole diameter in the rear-side punching section, passage resistance in the branch pipes is lowered. In other words, the passage resistance is lowered while securing the silencing effect on the front side.

According to an embodiment of the invention, the first outer tube is formed in a flat shape in side view, and the upper surface portion and the lower surface portion of the first outer tube are formed to be inclined rearwardly upward. When the first outer tube is formed in a flat shape and formed to be inclined rearwardly upward, the length of the first outer tube in the vehicle back-and-forth direction can be shortened, so that the first outer tube can be disposed on the further vehicle front side. Accordingly, the exhaust system can be disposed on the motorcycle in a small-sized form.

According to an embodiment of the invention, the first branch pipe and the second branch pipe are bent in an S shape in side view and then obliquely extended rearwardly upward.

When the first branch pipe and the second branch pipe are bent in an S shape and then obliquely extended rearwardly upward, the lengths of the branch pipes in the vehicle back-and-forth direction are shortened, so that the length of the first outer tube in the vehicle back-and-forth direction can also be reduced. The further reduction in the length of the first outer tube makes it possible to dispose the first outer tube on the much more vehicle front side, and to dispose the exhaust system on the motorcycle in a smaller-sized form.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be described below, based on the accompanying drawings. Incidentally, the drawings are to be viewed according to the orientation of reference symbols. The terms such as front/rear (forward/rearward), left/right (leftward/rightward), and up/down (upward/downward) used in the following description are those determined with reference to the rider seated on a rider seat.

Figure 1:
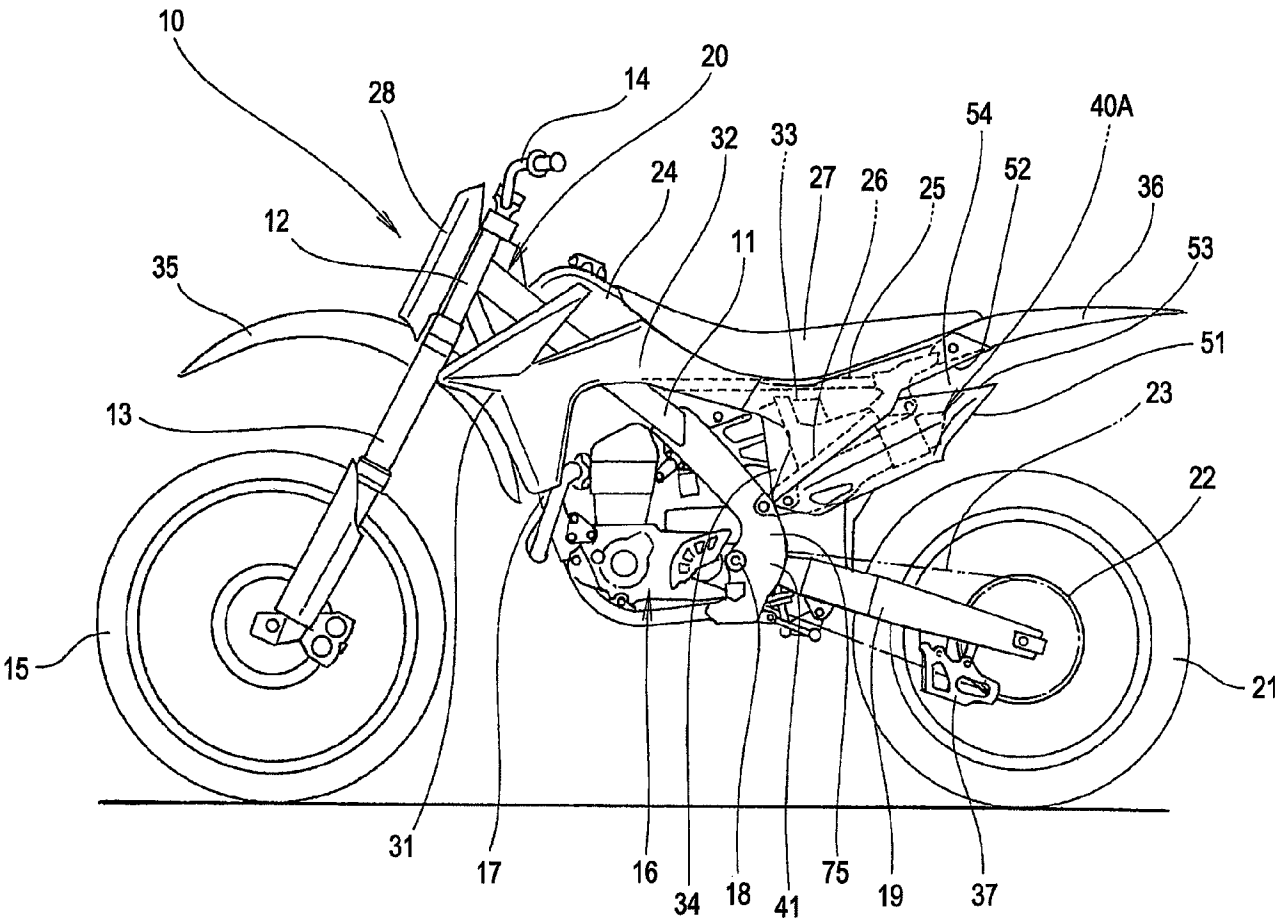
FIG. 1 is a left side view of a motorcycle pertaining to the present invention.

As shown in FIG. 1, a motorcycle 10 has a configuration in which: a front fork 13 is steerably mounted to a head pipe 12 provided at a front portion of a main frame 11; a steering handle 14 is attached to the upper end of the front fork 13; a front wheel 15 is rotatably mounted to the lower ends of the front fork 13; a single-cylinder engine 16 is suspended on the main frame 11; the engine 16 is surrounded by a down tube 17 extending downward from the head pipe 12; the rear end of the down tube 17 is connected to the lower ends of pivot plates 41 extending downward from the lower end of the main frame 11; a swing arm 19 is mounted to the pivot plates 41 through a pivot 18 so as to be swingable upward and downward; a rear wheel 21 is rotatably mounted to the rear end of the swing arm 19; a chain 23 for transmitting power of the engine 16 is wrapped around a sprocket 22 belonging to the rear wheel 21; a fuel tank 24 is mounted to a front portion of the main frame 11; seat rails 25 extend from the upper side of an intermediate portion of the main frame 11; rear portions 75 of the pivot plates 41 and the seat rails 25 are interconnected by rear pipes 26; and a seat 27 is placed on the seat rails 25 so as to be disposed over the rear wheel 21.

A body frame 20 includes the head pipe 12, the main frame 11, the pivot plates 41, the swing arm 19, the seat rails 25, and the down tube 17.

In addition, the front of the head pipe 12 is covered with a front number plate 28, the lateral sides of a front portion of the main frame 11 are covered with a shroud 31, the lateral sides of an intermediate portion of the main frame 11 are covered with front side covers 32 extending rearward from the shroud 31, the seat rails 25 and an air cleaner 33 are covered with rear side covers 34, and an exhaust system 40A (detailed later) connected to an exhaust port of the engine 16 and disposed on the lower side of the air cleaner 33 is covered with a rear number plate 51.

Further, between rear portion lower edges 52 of the rear side covers 34 and a rear portion upper edge 53 of the rear number plate 51, a V-shaped heat exhausting port section 54 is provided along the extension direction of the seat rails 25. Waste heat of the exhaust system 40A can be exhausted through the heat exhausting port section 54. Incidentally, while the rear side covers 34 and the rear number plate 51 are separate covers in this embodiment, the rear side covers 34 and the rear number plate 51 may be provided as an integral cover. In the case where such an integral cover is applied, the heat exhausting port section 54 may be replaced by a V-shaped heat exhausting cutout formed in the integral cover along the extension direction of the seat rails 25. In addition, the integral cover may be provided with a triangular heat exhausting opening along the extension direction of the seat rails 25. Now, the layout of the exhaust system 40A will be described below referring to FIG. 2.

Figure 2:
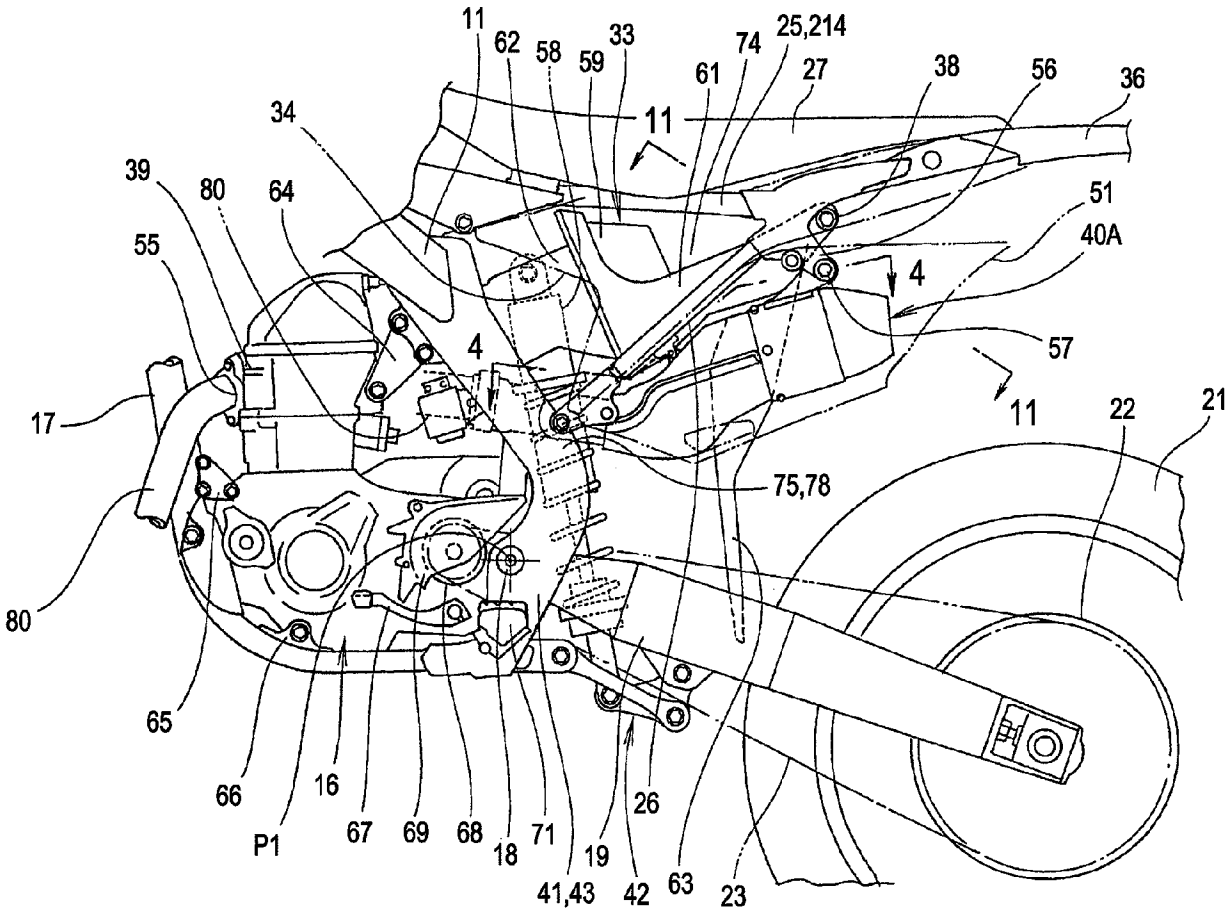
FIG. 2 is a left side view of a rear part of the motorcycle.

As shown in FIG. 2, an exhaust pipe 80 extends forward from an exhaust port 55 provided at a front portion of a cylinder head 39 of the engine 16, is bent to extend rearward on the right side of the vehicle body, further extends rearward through the inside of the pivot plates 41, and is connected to the exhaust system 40A. The exhaust system 40A is mounted by bolts 57 to a support member 56, which is attached to the seat rails 25 and the rear pipes 26.

A shock absorber 58 is mounted at its upper end to the main frame 11 and at its lower end to link mechanisms 42 which interconnect the pivot plates 41 and the swing arm 19, whereby swinging movements of the swing arm 19 are controlled. Incidentally, point P1 is the center point of swinging of the swing arm 19.

In addition, the air cleaner 33 is disposed in a space 74 surrounded by the seat rails 25 and the rear pipes 26. The air cleaner 33 has an element 59 housed in a cleaner case 61. The front end of the air cleaner 33 is connected to an intake port of the engine 16 through an intake-side duct 62, and the rear end of the cleaner case 61 is attached to the support member 56. Further, a mud guard 63 (detailed later) extending in the vertical direction to be used to block mud is attached to the cleaner case 61. Now, the configuration of the exhaust system 40A will be described below referring to FIG. 3.

Figure 3:
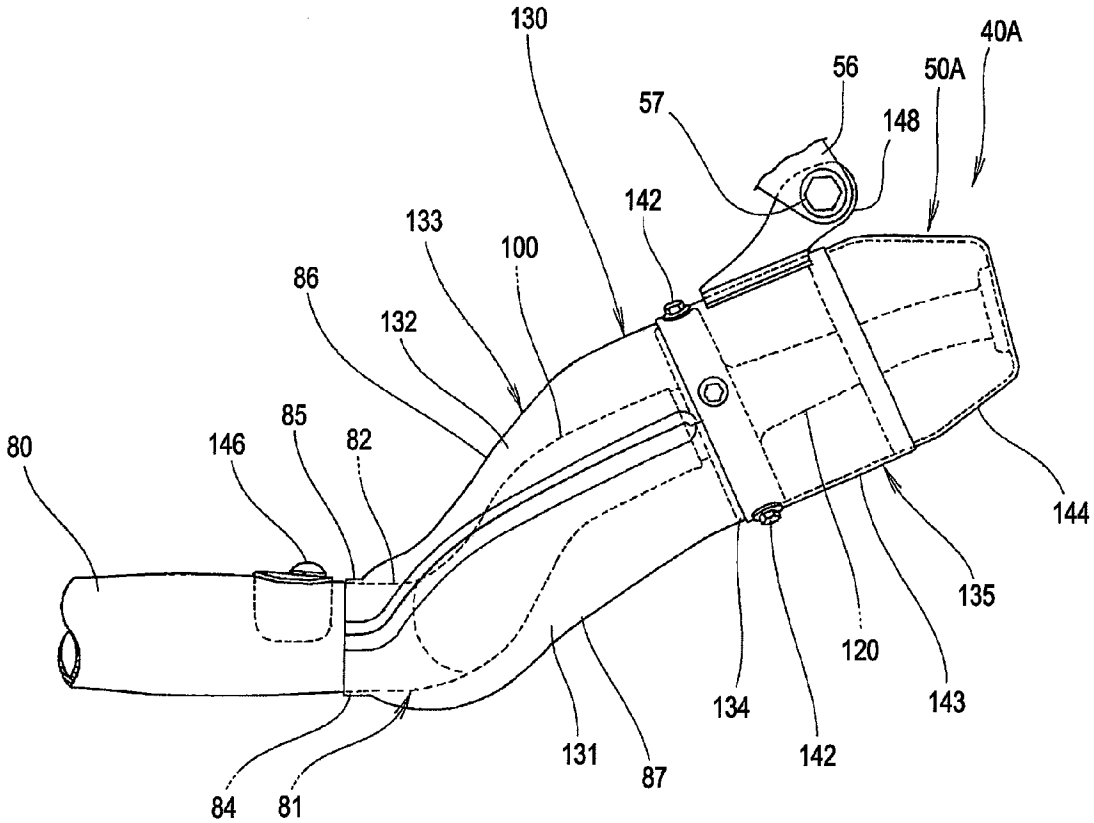
FIG. 3 is a left side view of an exhaust system.

As shown in FIG. 3, the exhaust system 40A includes: the exhaust pipe 80; a first branch pipe (described later) and a second branch pipe 100 (detailed later) which are connected to a branching section 82 (detailed later) provided at a rear portion 81 of the exhaust pipe 80; a first inner pipe (described later) connected to the first branch pipe and having been subjected to punching for permitting an exhaust gas to pass therethrough; a second inner pipe 120 (detailed later) connected to the second branch pipe 100 and having been subjected to punching for permitting the exhaust gas to pass therethrough; and a muffler 50A (detailed later) attached to the exhaust pipe 80.

The muffler 50A includes: an outer tube 130 which covers a front-side pipe portion 84 disposed forwardly of the branching section 82, the branching section 82, the first branch pipe, the second branch pipe 100, the first inner pipe, and the second inner pipe 120; and a sound absorbing material (described later) which is placed in the outer tube 130.

The outer tube 130 includes: a first outer tube 133 covering the part ranging from the front-side pipe portion 84 to the first branch pipe and the second branch pipe 100; a second right outer tube (described later) which is detachably attached to a right end portion of the first outer tube 133 and covers the first inner pipe; and a second left outer tube 135 (detailed later) which is detachably attached to a left end portion 134 of the first outer tube 133 and covers the second inner pipe 120. In addition, the first outer tube 133 includes a lower half 131 disposed on the lower side and an upper half 132 attached to the lower half 131.

The first outer tube 133 is formed in a flat shape in side view, and an upper surface portion 86 and a lower surface portion 87 of the first outer tube 133 are formed to be inclined rearwardly upward. With the first outer tube 133 thus formed in a flat shape and formed to be inclined rearwardly upward, the length of the first outer tube 133 in the vehicle back-and-forth direction can be shortened and, therefore, the first outer tube 133 can be disposed on the more vehicle front side. Consequently, the exhaust system 40A can be disposed on the motorcycle (FIG. 1, symbol 10) in a small-sized form.

Each of the first branch pipe and the second branch pipe 100 is curved in an S shape in side view, and is then obliquely extended rearwardly upward. With each of the first branch pipe and the second branch pipe 100 thus bent in an S shape and then obliquely extended rearwardly upward, the length of the branch pipe 100 in the vehicle back-and-forth direction can be shortened and, therefore, the length of the first outer tube 133 in the vehicle back-and-forth direction can also be shortened. With the length of the first outer tube 133 further shortened, the first outer tube 133 can be disposed on the much more vehicle front side, so that the exhaust system 40A can be disposed on the motorcycle in a further small-sized form. Now, the configuration of the branch pipe(s) and the inner pipe and the outer tube will be described in detail below referring to FIG. 4.

Figure 4:
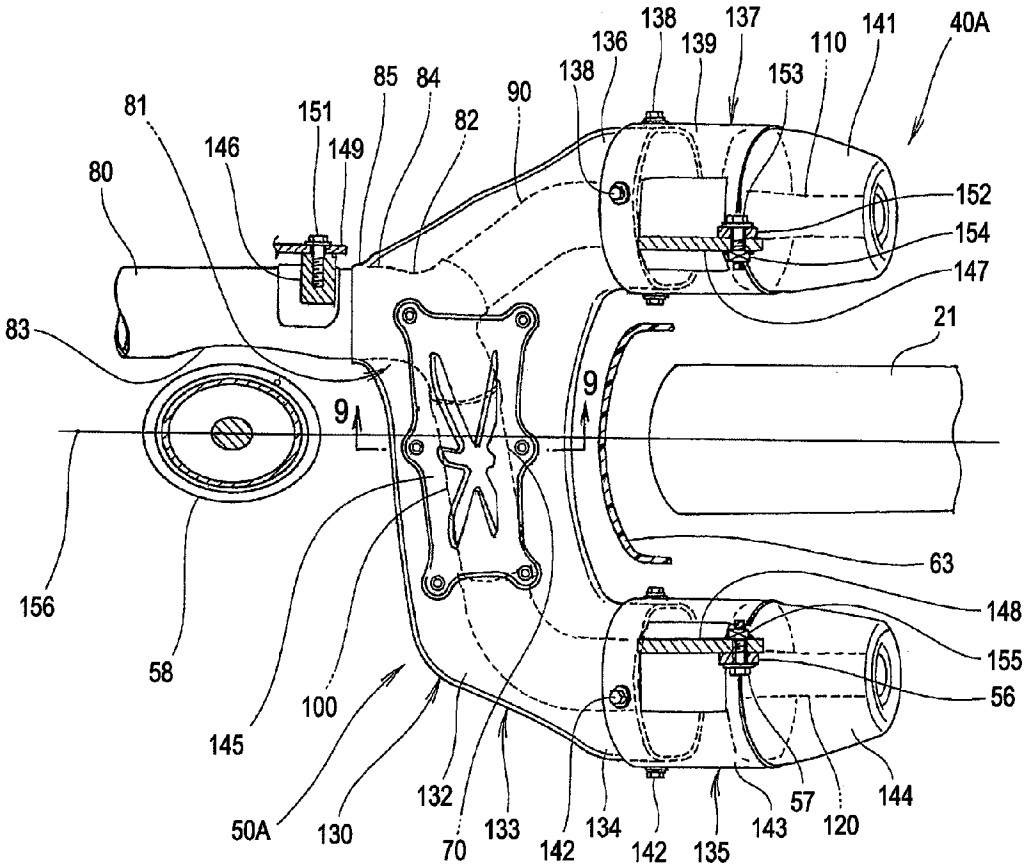
FIG. 4 is a sectional view taken along line 4-4 of FIG. 2.

As shown in FIG. 4, the branching section 82 at the exhaust pipe rear portion 81 is branched into a left part and a right part along the vehicle width direction. To the right side of the branching section 82 the first branch pipe 90 is connected which extends to the vehicle right side. To the left side of the branching part 82 the second branch pipe 100 is connected which extends to the vehicle left side through a space between the shock absorber 58 and the rear wheel 21.

In addition, the branching section 82, the second branch pipe 100 and the second inner pipe 120 are integral with the exhaust pipe 80. Therefore, that portion of the second branch pipe 100 which is in the vicinity of a vehicle center line 156 constitutes a transverse portion 70 of the exhaust pipe 80 which transverses from the vehicle right side to the vehicle left side on the front side of the rear wheel 21.

The outer tube 130 is so formed as to integrally cover the part ranging from the front-side pipe portion 84 to the branching section 82, the first branch pipe 90 and the first inner pipe 110, the second branch pipe 100 and the second inner pipe 120, in a U shape in plan view.

Besides, the outer tube 130 includes: a first outer tube 133 which covers the front-side pipe portion 84 and the branching section 82 as well as the first branch pipe 90 and the second branch pipe 100; the second right outer tube 137 which is detachably attached to a right rear end portion 136 of the first outer tube 133 and covers the first inner pipe 110; and the second left outer tube 135 which is detachably attached to a left rear end portion 134 of the first outer tube 133 and covers the second inner pipe 120. Since the attachment of the second right outer tube 137 and the second left outer tube 135 to the first outer tube 133 is tube-to-tube mounting, the assemblage of the outer tube 130 is easy to carry out.

In addition, the second right outer tube 137 includes a right tube portion 139 which is attached to the right rear end portion 136 of the first outer tube 133 by bolts 138 and covers a front portion of the first inner pipe 110, and a right rear cover 141 which is attached to the right tube portion 139 and covers a rear portion of the first inner pipe 110. Further, the second left outer tube 135 includes a left tube portion 143 which is attached to the left rear end portion 134 of the first outer tube 133 by bolts 142 and covers a front portion of the second inner pipe 120, and a left rear cover 144 which is attached to the left tube portion 143 and covers a rear portion of the second inner pipe 120.

To the vehicle-width-directional center of the first outer tube 133, a maintenance lid 145 (detailed later) is attached which is used at the time of packing the sound absorbing material in the outer tube.

Figure 10:
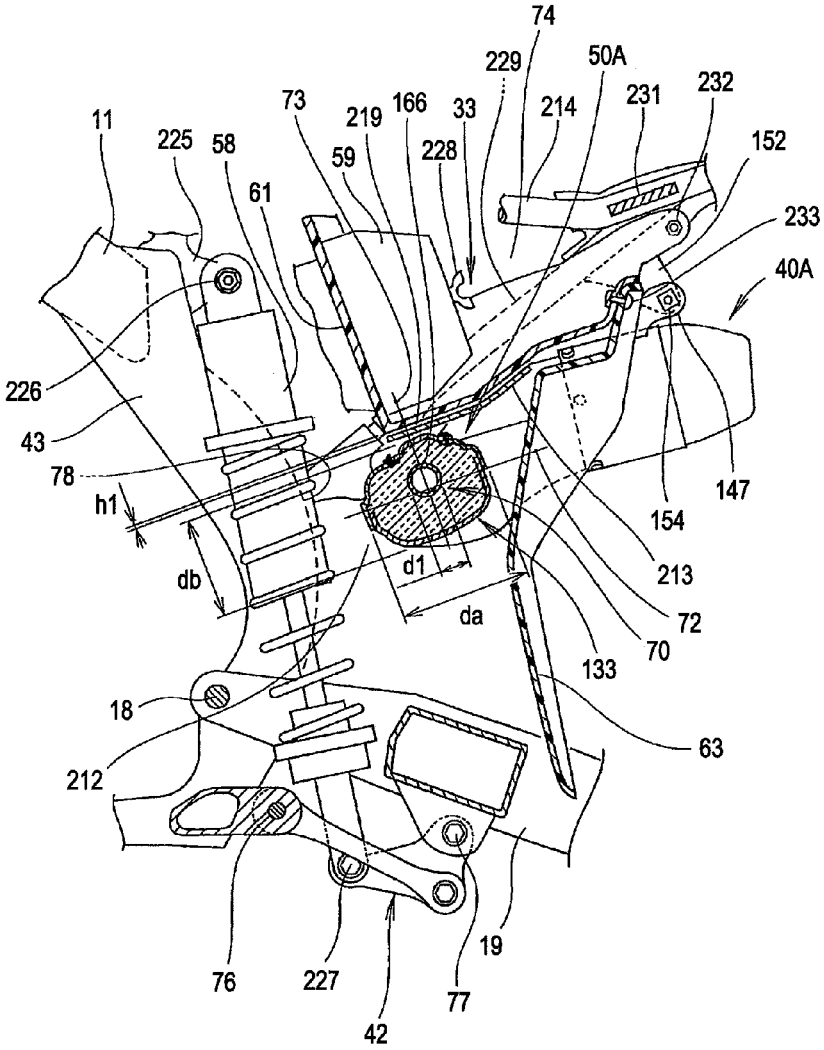
FIG. 10 is a sectional view of a rear part of a motorcycle.

The exhaust pipe 80 is provided with a front mounting member 146, while the right tube portion 139 is provided with a right rear mounting member 147, and the left tube portion 143 is provided with a left rear mounting member 148. The front mounting member 146 is connected to a front support member 149 provided on the pivot plate (FIG. 10, symbol 43). The right rear mounting member 147 is connected to a right rear support member 152 provided on the right-side seat rail (FIG. 10, symbol 214) and the rear pipe (FIG. 10, symbol 229). The left rear mounting member 148 is connected to a left rear support member 56 provided on the left-side seat rail (FIG. 2, symbol 25) and the rear pipe (FIG. 2, symbol 26). In other words, the exhaust pipe and the inner pipes and the outer tube are supported to the vehicle body side at three points. Incidentally, line 156 is the vehicle center line on a vehicle-width-directional basis. Now, the procedure of assembly of the exhaust pipe and the inner pipes and the outer tube will be described below referring to FIG. 5.

Figure 5:
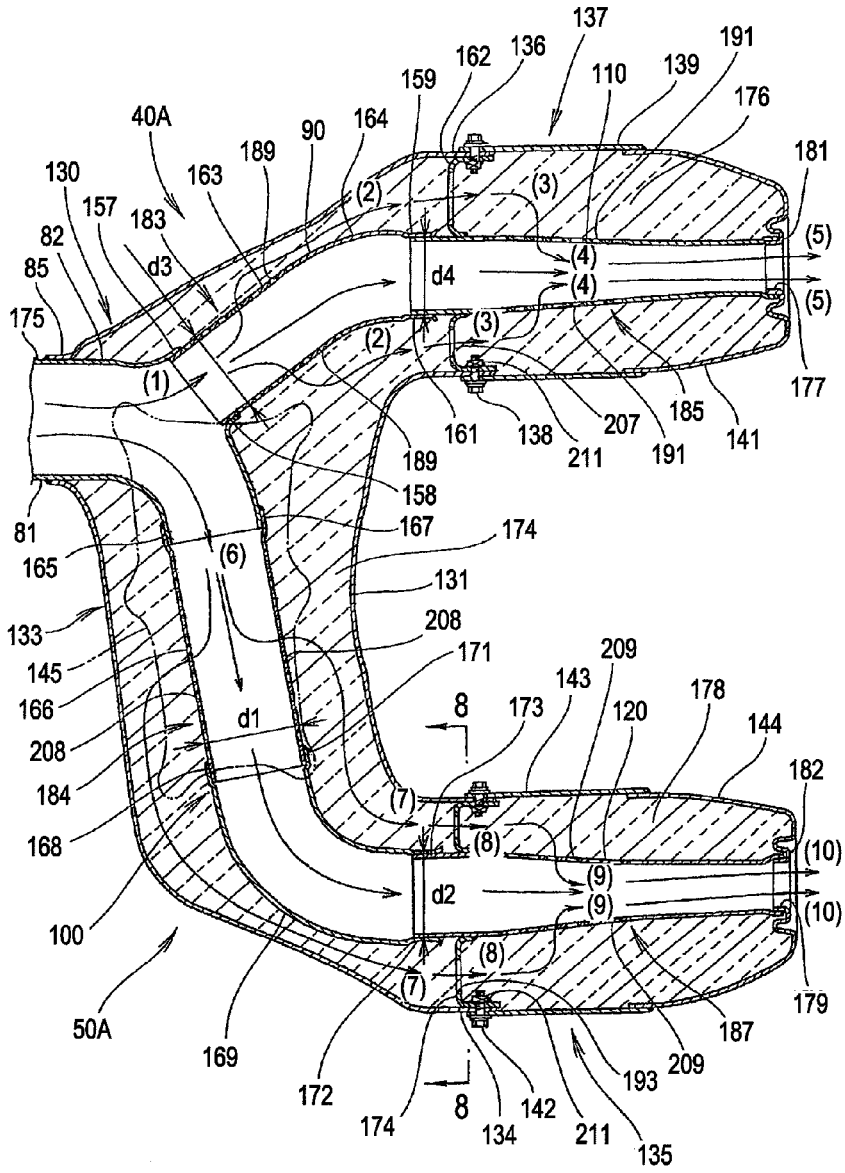
FIG. 5 is a sectional view of the exhaust system.

As shown in FIG. 5, a front end 158 of the first branch pipe 90 is inserted into a right rear end 157 of the branching section 82, and the branching section 82 and the first branch pipe 90 are connected together by welding. A front end 161 of the first inner pipe 110 is inserted into a rear end 159 of the first branch pipe 90, and a toroidal first separator 162 (detailed later) is attached to the first inner pipe 110 by welding. Incidentally, the first branch pipe 90 has a rectilinear portion 163 and a curved portion 164.

On the other hand, a front end 167 of a rectilinear portion 166 of the second branch pipe 100 is fitted over a left rear end 165 of the branching section 82, and the branching section 82 and the rectilinear portion 166 are connected together by welding. A front end 171 of a curved portion 169 of the second branch pipe 100 is fitted over a rear end 168 of the rectilinear portion 166, and the rectilinear portion 166 and the curved portion 169 are connected together by welding. Incidentally, while the rectilinear portion 166 and the curved portion 169 are provided in a split structure in this embodiment, they may be provided in an integral structure.

A front end 173 of the second inner pipe 120 is inserted into a rear end 172 of the curved portion 169, and a toroidal second separator 174 (detailed later) is attached to the second inner pipe 120 by welding. An assembly in which the parts ranging from the branching section 82 to the inner pipes 110, 120 are interconnected is assembled with the lower half 131, the upper half (FIG. 3, symbol 132) and a first sound absorbing material 174. In addition, a front end 175 of the branching section 82 is integrated with the lower half 131 and the upper half by welding.

The right tube portion 139 of the second right outer tube 137 is fitted over the right rear end portion 136 of the first outer tube 133, and a first separator 162 and the right rear end portion 136 and the right tube portion 139 are interconnected by bolts 138. The right tube portion 139 is packed with a second right sound absorbing material 176. The right rear cover 141 is inserted into the right tube portion 139, and the right rear cover 139 and the right rear cover 141 are connected together by welding. Consequently, a rear end hole section of the right rear cover 141 to which the rear end of the first inner pipe 110 is fitted constitutes a first exhaust port 177.

On the other hand, the left tube portion 143 of the second left outer tube 135 is fitted over the left rear end portion 134 of the first outer tube 133, and the second separator 174 and the left rear end portion 134 and the left tube portion 143 are interconnected by bolts 142. The left tube portion 143 is packed with a second sound absorbing material 178. The left rear cover 144 is inserted into the left tube portion 143, and the left tube portion 143 and the left rear cover 144 are connected together by welding. As a result, a rear end hole section of the left rear cover 144 to which the rear end of the second inner pipe 120 is fitted constitutes a second exhaust port 179. Thus, the assembly of the exhaust pipe and the inner pipes and the outer tube is completed. Incidentally, while the separator 162 and the rear end portion 136 and the tube portion 139 are interconnected by the bolts 138 whereas the separator 174 and the rear end portion 134 and the tube portion 143 are interconnected by the bolts 142 in the present embodiment, the interconnection of the separator and the rear end portion and the tube portion may be conducted by use of rivets in place of the bolts.

The right rear cover 141 is provided at a rear end portion thereof with a right pipe support section 181 which projects forward for insertion into the rear end of the first inner pipe 110 and supports the rear end of the first inner pipe 110. Similarly, the left rear cover 144 is provided at a rear end portion thereof with a left pipe support section 182 which projects forward for insertion into the rear end of the second inner pipe 120 and supports the rear end of the second inner pipe 120. Since the right pipe support section 181 supports the rear end of the first inner pipe 110 and the left pipe support section 182 supports the rear end of the second inner pipe 120, both the support sections 181, 182 prevent the branch pipes 90, 100 and the inner pipes 110, 120 from being vibrated.

The second branch pipe 100 and the second inner pipe 120 are formed to be greater in diameter than the first branch pipe 90 and the first inner pipe 110. Let the outside diameter of the second branch pipe 100 be d1, the outside diameter of the inlet of the second inner pipe 120 be d2, the outside diameter of the first branch pipe 90 be d3, and the outside diameter of the inlet of the first inner pipe 110 be d4, then d1>d3 and d2>d4.

Further, the second branch pipe 100 extends between the shock absorber (FIG. 4, symbol 58) and the rear wheel (FIG. 4, symbol 21) to the vehicle left side opposite to the side where the first branch pipe 90 is disposed; therefore, the length of the second branch pipe 100 is greater than the length of the first branch pipe 90. The second branch pipe 100 and the second inner pipe 120 comparatively greater in flow path length are formed to be larger in diameter, whereby the flow rate of an exhaust gas flowing through the second branch pipe 100 and the second inner pipe 120 is increased. Consequently, it is ensured that the exhaust gas flows through the left branch pipe 100 and inner pipe 120 and through the right branch pipe 90 and inner pipe 110 in a well-balanced manner.

The first branch pipe 90 and the first inner pipe 110 are gradually decreased in diameter as the first exhaust port 177 is approached; similarly, the second branch pipe 100 and the second inner pipe 120 are gradually decreased in diameter as the second exhaust port 179 is approached. Thus, passage resistance is raised gradually as the exhaust port 177 is approached, whereby an exhaust pressure is diffused to the sides of the sound absorbing materials 174, 176 and release of the exhaust gas can be secured. Similarly, passage resistance is raised gradually as the exhaust port 179 is approached, whereby acoustic energy of the exhaust can be absorbed into the sound absorbing materials 174, 176, 178, so that a silencing effect is enhanced. Now, the layout of the punching sections will be described below referring to FIG. 6.

Figure 6:
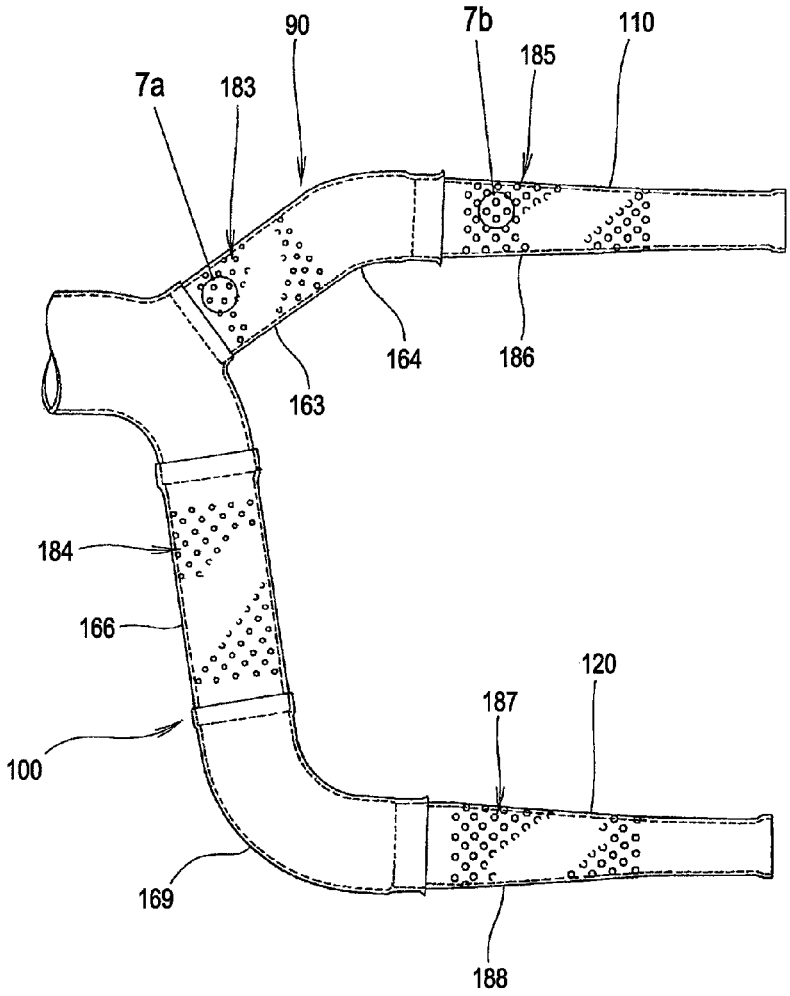
FIG. 6 is a plan view of an exhaust pipe rear portion and an inner pipe.

As shown in FIG. 6, a front-side right punching section 183 (detailed later) through which the exhaust gas flows is added to the rectilinear portion 163 of the first branch pipe 90, and the front-side right punching section 183 is not added to the curved portion 164 of the first branch pipe 90. In addition, a front-side left punching section 184 (detailed later) is added to the rectilinear portion 166 of the second branch pipe 100, and the front-side left punching section 184 is not added to the curved portion 169 of the second branch pipe 100.

When the exhaust gas flows through the curved portions 164, 169, unevenness of exhaust flow is generated due to a centrifugal force or the like. Since the front-side punching section is not disposed in the parts where such unevenness is generated, the sound pressure can be evenly diffused into the sound absorbing material (FIG. 5, symbol 174).

In addition, a rear-side right punching section 185 (detailed later) through which the exhaust gas flows is provided at a front portion 186 of the first inner pipe 110, and a rear left-side punching section 187 (detailed later) is provided at a front portion 188 of the second inner pipe 120.

Further, the branch pipes 90, 100 and the inner pipes 110, 120 are each provided with a punching section. The exhaust gas flows via the punching sections into the sound absorbing materials, whereby acoustic energy of the exhaust is absorbed. Now, the hole diameter in the punching sections is described below referring to FIGS. 7 (*a*) and (*b*).

Figure 7A:
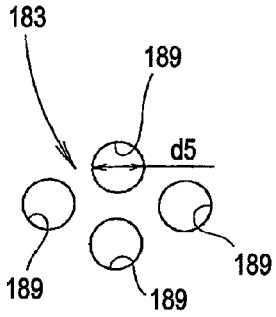
FIG. 7(*a*) illustrates the hole diameter in a front-side punching section and FIG. 7(*b*) illustrates the hole diameter in a rear-side punching section.
Figure 7B:
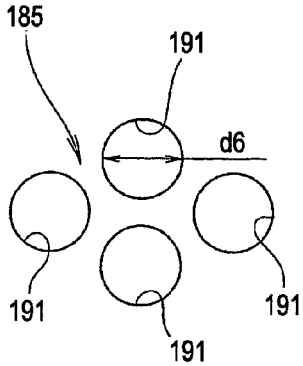

In FIG. 7 (*a*) shows the layout of holes 189 in the front-side right punching section 183, and (*b*) shows the layout of holes 191 in the rear-side right punching section 185. Let the diameter of the circular holes 189 in (*a*) be d5, and let the diameter of the circular holes 191 in (*b*) be d6, then the hole diameter d5 in the front-side right punching section 183 is set to be smaller than the hole diameter d6 in the rear-side right punching section 185.

When the exhaust gas passes the front-side right punching section 183, the acoustic energy of the exhaust is absorbed, so that a silencing effect is exhibited. In addition, since the hole diameter d5 in the front-side right punching section 183 is set smaller than the hole diameter d6 in the rear-side right punching section 185, passage resistance in the branch pipe (FIG. 6, symbol 90) is lowered. Thus, on the front side the passage resistance is lowered while the silencing effect is secured.

Incidentally, while the holes in the front-side right punching section 183 and the rear-side right punching section 185 are circular in shape in this embodiment, the holes may be elliptic in shape. In addition, the hole diameter in the front-side left punching section (FIG. 6, symbol 184) is equal to the hole diameter in the front-side right punching section 183, and the hole diameter in the rear-side left punching section (FIG. 6, symbol 187) is equal to the hole diameter in the rear-side right punching section 185. Now, the structure of the separator provided at the left rear end portion (FIG. 5, symbol 134) of the first outer tube (FIG. 5, symbol 133) will be described below referring to FIG. 8.

Figure 8:
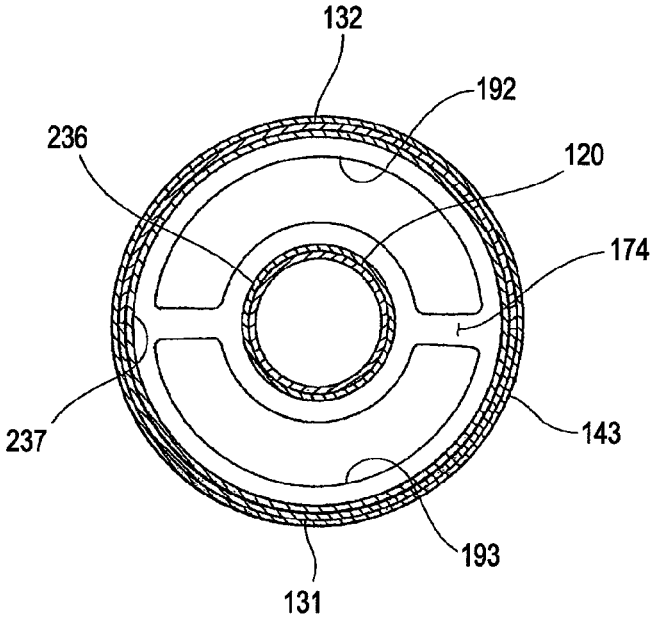
FIG. 8 is a sectional view taken along line 8-8 of FIG. 5.

As shown in FIG. 8, the second separator 174 is provided on the upper side with an arcuate upper-side opening 192 which is so provided as to surround the second inner pipe 120 over a range of about 180° and through which the exhaust gas flows, and is provided on the lower side with an arcuate lower-side opening 193 which is so provided as to surround the second inner pipe 120 over a range of about 180° and through which the exhaust gas flows.

Incidentally, while the structure of the separator has been described with respect to the second separator 174 as a representative example in the present embodiment, the structure of the first separator (FIG. 5, symbol 162) is the same as that of the second separator 174 and, therefore, description thereof is omitted. Now, the structure of the maintenance lid (FIG. 4, symbol 145) provided on the first outer tube (FIG. 4, symbol 133) will be described below referring to FIG. 9.

Figure 9:
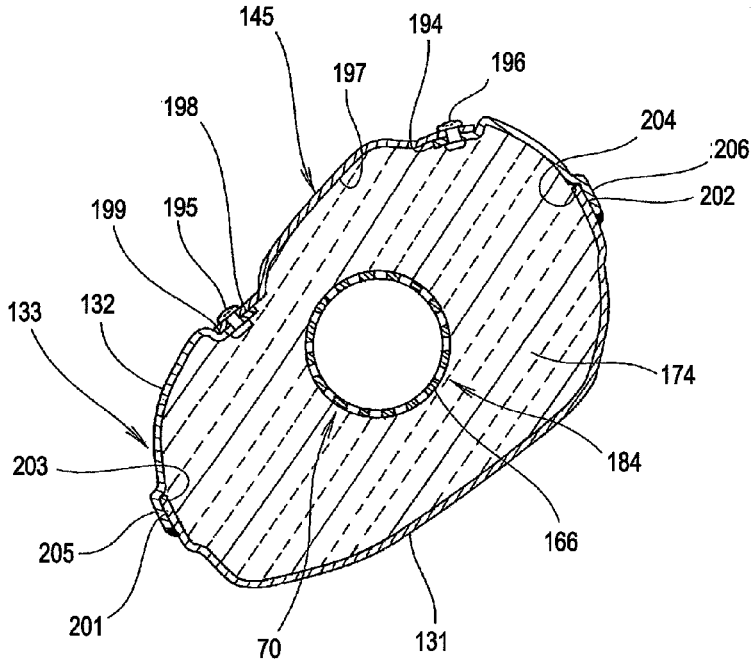
FIG. 9 is a sectional view taken along line 9-9 of FIG. 4.

As shown in FIG. 9, on the upper half 132 of the first outer tube 133 the maintenance lid 145 is provided which covers the front-side left punching portion 184 disposed at the rectilinear portion 166 of the second branch pipe (FIG. 5, symbol 100).

Since the second branch pipe is also a pipe passing between the shock absorber (FIG. 4, symbol 58) and the rear wheel (FIG. 4, symbol 21), the rectilinear portion 166 of the second branch pipe is located in the vicinity of the vehicle-width-directional center of the first outer tube 133. In other words, the maintenance lid 145 is provided in the vicinity of the center of the first outer tube 133, so that the first outer tube 133 can easily be packed with the sound absorbing material 174.

In addition, the maintenance lid 145 is attached to the upper half 132 by rivets 195, 196 so as to close a maintenance opening 194 provided in an upper portion of the upper half 132. The rivets 195, 196 are preferably blind rivets. Besides, the maintenance lid 145 is provided with bead portions 197 which are formed to project toward a front upper side and enhances rigidity.

The upper half 132 is provided at an upper portion thereof with a lid support section 198 for supporting the maintenance lid 145, and the lid support section 198 is provided at the periphery thereof with an upper end bent portion 199 for engagement with the outer edge of the maintenance lid 145. With the outer edge of the maintenance lid 145 engaged with the upper end bent portion 199, assemblage of the maintenance lid 145 is facilitated. Incidentally, as the mounting parts for the maintenance lid 145, bolts may be used in place of the rivets 195, 196. When bolts are used, shortening of the working time in maintenance can be expected.

The first outer tube 133 has the lower half 131 and the upper half 132 integrated with each other by welding. The lower half 131 is provided with lower-side connecting sections 201, 202 at both sides of an upper portion thereof. On the other hand, the upper half 132 is provided with upper-side connecting sections 205, 206 at both sides of a lower portion thereof through lower end bent portions 203, 204. The upper ends of the lower-side connecting sections 201, 202 are put into contact with the lower end bent portions 203, 204, whereby alignment of the lower half 131 and the upper half 132 can be carried out easily.

Operation of the exhaust system 40A as above will be described below.

In FIG. 5, the exhaust gas flows from the branching section 82 into the first branch pipe 90 as indicated by arrow (1), and then flows through the holes 189 in the front-side right punching section 183 into the first sound absorbing material 174 as indicated by arrow (2). The acoustic energy of the exhaust is first absorbed by the first sound absorbing material 174.

The exhaust gas having passed the first sound absorbing material 174 flows through openings 207 in the first separator 162 into the second right sound absorbing material 176 as indicated by arrow (3). The acoustic energy of the exhaust is further absorbed by the second right sound absorbing material 176, so that exhaust noise is reduced. The exhaust gas having passed the second right sound absorbing material 176 flows through the holes 191 in the rear-side right punching section 185 into the first inner pipe 110 as indicated by arrow (4), and is exhausted via the first exhaust port 177 as indicated by arrow (5).

On the other hand, when the exhaust gas flows via the branching section 82 into the rectilinear portion 166 of the second branch pipe 100 as indicated by arrow (6), the exhaust gas then flows through holes 208 in the front-side left punching section 184 into the first sound absorbing material 174 as indicated by arrow (7). The acoustic energy of the exhaust is first absorbed by the first sound absorbing material 174.

The exhaust gas having passed the first sound absorbing material 174 then flows through openings 193 in the second separator 174 into the second left sound absorbing material 178 as indicated by arrow (8). The acoustic energy of the exhaust is further absorbed by the second left sound absorbing material 178, so that exhaust noise is reduced. The exhaust gas having passed the second left sound absorbing material 178 then flows through holes 209 in the rear-side left punching section 187 into the second inner pipe 120 as indicated by arrow (9), and is exhausted through the second exhaust port 179 as indicated by arrow (10).

In the exhaust system 40A, the exhaust pipe rear portion 81 also has a muffler structure. A front end 85 of the outer tube 130 corresponding to the outer shell of the muffler 50A is disposed on the vehicle (FIG. 1, symbol 10) front side relative to the branching section 82, where the two branch pipes 90, 100 are branched, by making use of a dead space. Therefore, the exhaust system 40A is disposed on the more vehicle front side, while increasing the capacity of the muffler 50A. As a result, there is provided the exhaust system 40A for the motorcycle (FIG. 1, symbol 10) that has a favorable external appearance and promises easy realization of mass concentration.

Meanwhile, in a motorcycle, a large number of component parts are mounted to a vehicle body, so that narrow spaces are liable to be generated between these component parts. If the spaces are utilized as a part for disposing the exhaust system 40A, the exhaust system 40A can be disposed in the motorcycle in a small-sized form. An example of this will be described below.

As shown in FIG. 10, the first outer tube 133 of the muffler 50A is disposed in a space 212 defined by a rear part of the shock absorber 58 interconnecting a support member 225 of the main frame 11 and the swing arm 19, a lower part of the air cleaner 33 attached to the right rear support member 152, and an upper part of the swing arm 19.

The space 212 is an empty part possessed by the motorcycle (FIG. 1, symbol 10), and by disposing the first outer tube 133 in this empty space it is possible to dispose the muffler 50A in the motorcycle in a small-sized form.

In addition, the first outer tube 133 having an outside diameter greater than the outside diameter d1 of the rectilinear portion 166 of the second branch pipe (FIG. 6, symbol 100) is disposed at the transverse section 70 of the exhaust pipe (FIG. 4, symbol 80). Since the first outer tube 133 is formed to be roughly elliptic in sectional shape, the outside diameter of the first outer tube 133 is represented by a major diameter $d_a$ as the length in the direction of a major axis 72 and a major diameter $d_b$ as the length in the direction of a minor axis 73.

When the first outer tube 133 of the muffler 50A is disposed between the swing arm 19 and the seat (FIG. 2, symbol 27) along the transverse section 70 of the exhaust pipe, the muffler 50A can be disposed on the more forward side while securing the capacity thereof, so that protrusion of the muffler 50A toward the vehicle rear side can be suppressed. In other words, the motorcycle (FIG. 1, symbol 10) can be provided with the muffler 50A in a smaller-sized form. In addition, when the rearward protrusion of the muffler 50A is suppressed, the external appearance of the vehicle rear portion is enhanced. Therefore, it is possible to provide a motorcycle in which the muffler 50A can be provided in a smaller-sized form and the external appearance of a vehicle rear portion is enhanced. Incidentally, while the muffler 50A is formed to be roughly elliptical in sectional shape in the present embodiment, it may be formed to be circular in section.

Further, a heat shield panel 213 functioning also as a heat insulating material is disposed at a position spaced downward from a bottom surface of the cleaner case 61 by a height h1. This ensures that a heat insulating layer 219 having a gap h1 can be secured between the bottom surface of the cleaner case 61 and the heat shield panel 213, and a heat insulating effect can be expected. Now, the layout of the heat shield panel 213 in the vehicle width direction will be described below referring to FIG. 11.

Figure 11:
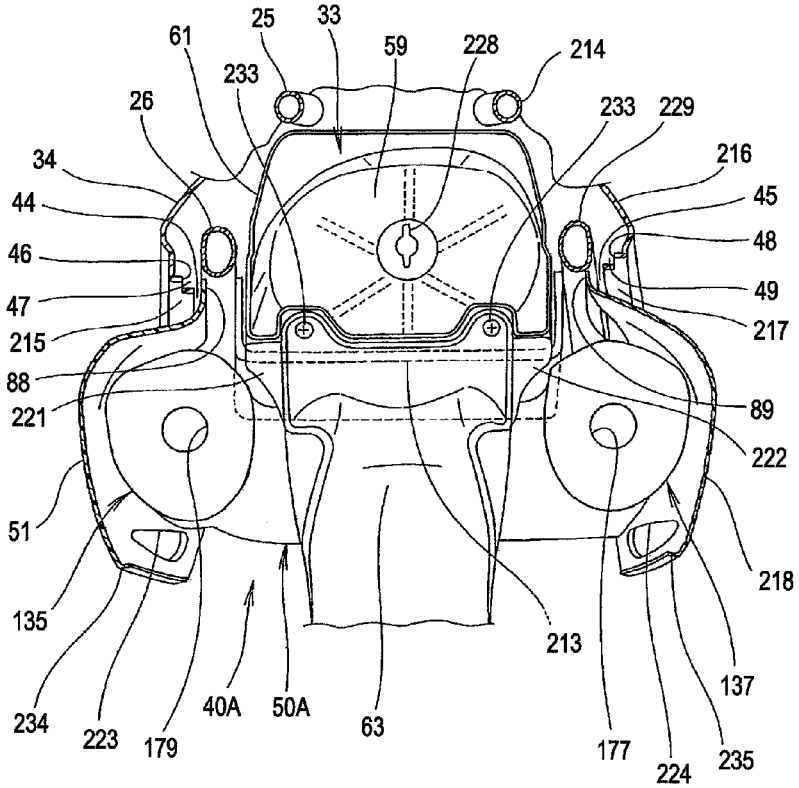
FIG. 11 is a sectional view taken along line 11-11 of FIG. 2.

In FIG. 11, a pair of left and right rear pipes 26, 229 are members for interconnecting rear portions (FIG. 2, symbols 75 and 78) of the left and right pivot plates (FIG. 2, symbols 41 and 43) and the left and right seat rails 25, 214. The heat shield panel 213 for shielding the heat tending to be transferred from the muffler 50A to the air cleaner 33 is provided to extend between the left-side rear pipe 26 and the right-side rear pipe 229 and to pass between the air cleaner 33 and the muffler 50A. The heat shield panel 213 is a U-shaped member.

Since the heat shield panel 213 extending between the rear pipes 26 and 229 is provided between the air cleaner 33 and the muffler 50A, the heat of the muffler 50A is transferred through the heat shield panel 213 to the rear pipes 26, 229. Thus, the heat of the muffler 50A is unlikely to be transferred to the air cleaner 33, so that the temperature of the air cleaner 33 itself can be prevented from being raised.

In addition, a vehicle left side portion is covered with the left rear side cover 34, and a left-side rear number plate 51 is disposed on the rear lower side of the side cover 34 and on the left side of the muffler 50A. A left-side cavity section 44 extending in the vehicle back-and-forth direction is formed between the side cover 34 and the rear number plate 51 so as to extend along the left-side rear pipe 26. Besides, a vehicle right side portion is covered with a right rear side cover 216, and a right-side rear number plate 218 is disposed on the rear lower side of the side cover 216 and on the right side of the muffler 50A. A right-side cavity section 45 extending in the vehicle back-and-forth direction is formed between the side cover 216 and the rear number plate 218 so as to extend along the right-side rear pipe 229.

When the left-side cavity section 44 is formed between the side cover 34 and the rear number plate 51 and the right-side cavity section 45 is formed between the side cover 216 and the rear number plate 218, an airflow (induced by the traveling of the vehicle) can easily flow from the outside of the vehicle body into the inside of the vehicle body through the cavity sections 44, 45, so that the air cleaner 33 can be stably supplied with air.

Further, at a lower edge portion of the left rear side cover 34 a left-side rib 215 is provided which extends toward the inside of the vehicle body and defines the left-side cavity section 44. The rib 215 is so formed as to close a gap between the rear pipe 26 and the lower edge portion of the side cover 34. A part of the rib 215 is cut out to provide a left-side cutout section 46, whereby a left rib-side cavity 47 is formed between the rib 215 and the rear pipe 26. Besides, at a lower edge portion of the right rear side cover 216 a right-side rib 217 is provided which extends toward the inside of the vehicle body and defines the right-side cavity section 45. The rib 217 is so formed as to close a gap between the rear pipe 229 and the lower edge portion of the side cover 216. A part of the rib 217 is cut out to provide a right-side cutout section 48, whereby a right rib-side cavity 49 is formed between the rib 217 and the rear pipe 229.

When the rib-side cavity 47 is thus provided between the left-side rib 215 and the rear pipe 26 in addition to the cavity section 44, the airflow can further be introduced into the inside of the vehicle body through the cavity section 44 and the rib-side cavity 47, so that the air cleaner 33 can be supplied with air more stably. Similarly, when the rib-side cavity 49 is thus provided between the right-side rib 217 and the rear pipe 229 in addition to the cavity section 45, the airflow can further be introduced into the inside of the vehicle body through the cavity section 45 and the rib-side cavity 49, so that the air cleaner 33 can be supplied with air further stably. Incidentally, while the cutout sections 46, 48 are provided at two positions in the present embodiment, cutout sections may be provided at two or more positions along the vehicle back-and-forth direction; namely, the number of the cutout sections may be increased.

A left-side upper edge portion 88 of the left-side rear number plate 51 is a part defining the left-side cavity section 44, and is located proximate to the rear pipe 26 while entering the inner side of the vehicle body than the rib 215 provided at the lower edge portion of the left rear side cover 34. In addition, a right-side upper portion 89 of the right-side rear number plate 218 is a part defining the left-side cavity section 45, and is located proximate to the rear pipe 229 while entering the inner side of the vehicle body than the rib 217 provided at the lower edge portion of the right rear side cover 216.

When the upper edge portion 88 of the rear number plate 51 is thus located proximate to the rear pipe 26 and the upper edge portion 89 of the rear number plate 218 is thus located proximate to the rear pipe 229, the waste heat of the muffler 50A is prevented from making contact with the airflow introduced into the inside of the vehicle body, so that the temperature of air to be supplied to the air cleaner 33 can be prevented from being raised. In addition, the waste heat of the muffler 50A can be conveyed toward the vehicle rear side by an airflow introduced via a left opening 223 in the left-side rear number plate 51, and can be conveyed toward the vehicle rear side by an airflow introduced via a right opening 224 in the right-side rear number plate 218.

Besides, the mud guard 63 is disposed on the lower side of the air cleaner 33 so as to cover the rear side of the muffler 50A. The mud guard 63 is mounted to a rear end portion of the cleaner case 61. Further, a left ear section 221 covering the heat shield panel 213 in rear view is provided at the upper left end of the mud guard 63, and a right ear section 222 covering the heat shield panel 213 in rear view is provided at the upper right end of the mud guard 63. Since the ear sections 221, 222 can prevent mud from splashing onto the heat shield panel 213, the heat shielding performance of the heat shield panel 213 can be maintained.

In the exhaust system 40A as described above, the first outer tube (FIG. 3, symbol 133) of the muffler 50A has a horizontally split structure. When the structure of the first outer tube is restricted to one structure, the production cost of the first outer tube may be raised, depending on the conditions at the time of production. From such a point of view, it is preferable that the structure of the first outer tube can be selected appropriately from among many kinds of structures according to the conditions at the time of production. An example of the exhaust system in which the structure of the first outer tube is different from the horizontally split structure will be described below.

Figure 12:
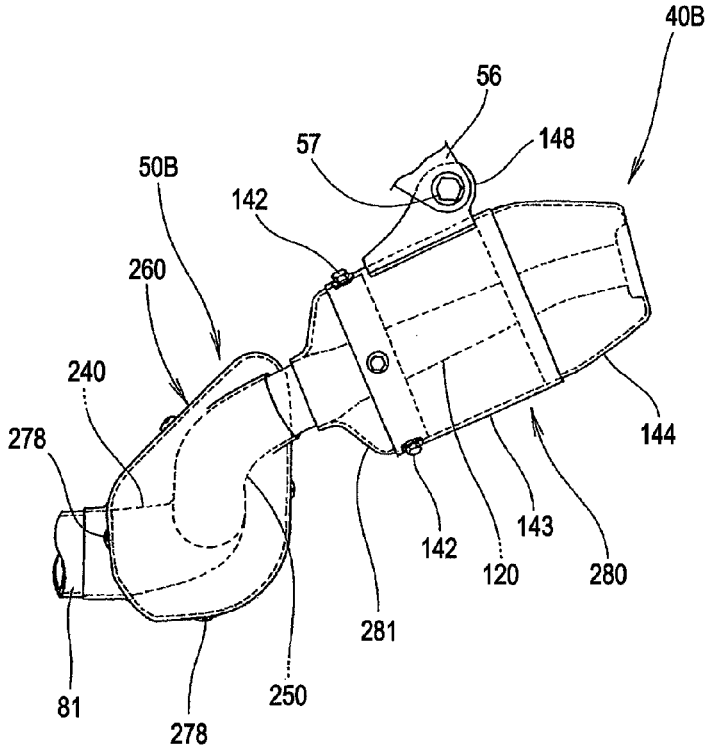
FIG. 12 is a view showing a modification of FIG. 3.

In FIG. 12, the structures common to FIGS. 3 and 12 are denoted by the same reference symbols as used above, and descriptions of such common structures are omitted. A principal point of modification resides in that a first outer tube 260 is of a socket-and-spigot type member which can be attached and detached in the vehicle width direction.

In the exhaust system 40B, the muffler 50B includes a first outer tube 260 (detailed later), a second right outer tube (described later), a second left outer tube 280 (detailed later), a first sound absorbing material (described later) placed in the first outer tube 260, a second right sound absorbing material (described later) placed in the second right outer tube, and a second left sound absorbing material (described later) placed in the second left outer tube 280.

The first outer tube 260 is a socket-and-spigot type member which can be attached and detached in the vehicle width direction. The first outer tube 260 covers a branching section 240 and a first branch pipe (described later) and a second branch pipe 250 (detailed later). The second right outer tube covers a first inner pipe (described later) connected to the first branch pipe, and a second left outer tube 280 covers a second inner pipe 120 connected to the second branch pipe 250. Now, the configuration of the branch pipes, inner pipes, first outer tube and second outer tube will be described in detail below referring to FIG. 13.

Figure 13:
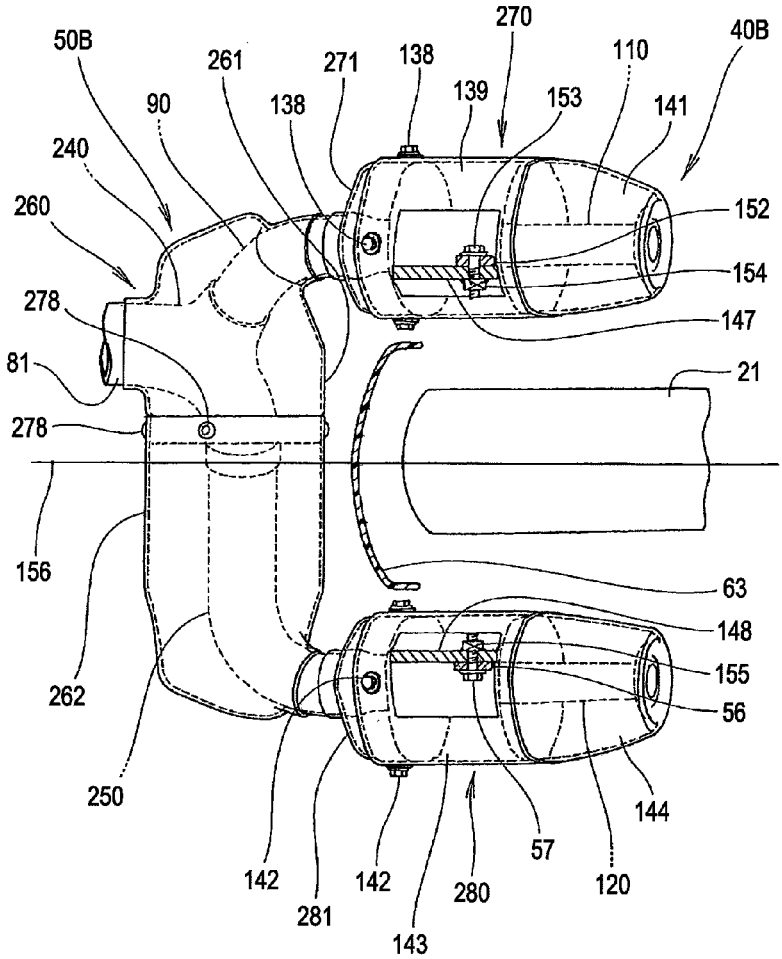
FIG. 13 is a view showing a modification of FIG. 4.

In FIG. 13, the structures common to FIGS. 4 and 13 are denoted by the same reference symbols as used above, and descriptions of such common structures are omitted.

The first outer tube 260 covers the branching section 240 branched into left and right parts along the vehicle width direction, the first branch pipe 90 connected to a right end portion of the branching section 240, and the second branch pipe 250 connected to a left end portion of the branching section 240. In addition, the first outer tube 260 includes a right half 261 located on the vehicle-width-directionally right side, and a left half 262 fitted to the right half 261 and located on the vehicle-width-directionally left side.

A first inner pipe 110 connected to the first branch pipe 90 is covered with a second right outer tube 270, and the second inner pipe 120 is covered with the second left outer tube 280 as above-mentioned.

The second right outer tube 270 includes a right front cover 271 which is attached to a rear end portion of the first branch pipe 90 and by which a front end portion of the first inner pipe 110 is covered, a right tube portion 139, and a right rear cover 141.

The second left outer tube 280 includes a left front cover 281 which is attached to a rear end portion of the second branch pipe 250 and by which a front end portion of the second inner pipe 120 is covered, a left tube portion 143, and a left rear cover 144. Now, the assembly structure of the exhaust pipe, inner pipes, first outer tube and second outer tube will be described below referring to FIG. 14.

Figure 14:
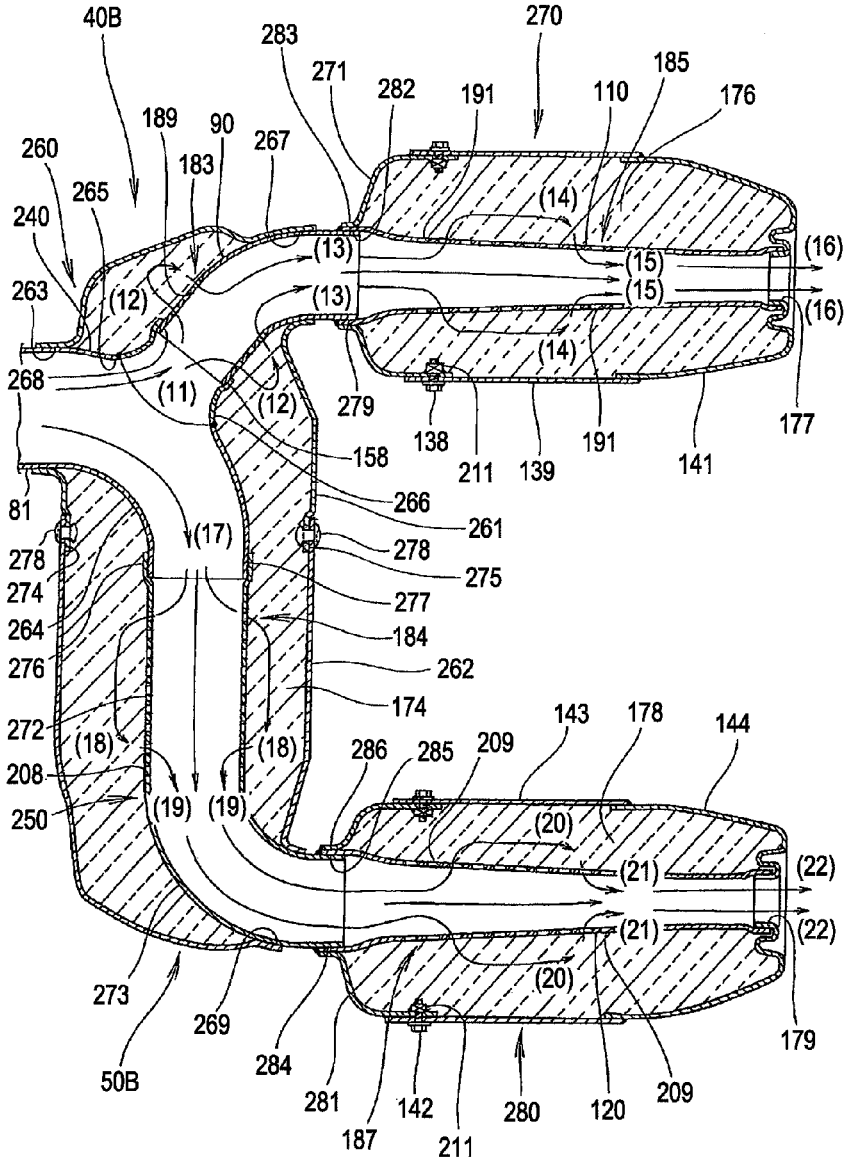
FIG. 14 is a view showing a modification of FIG. 5

In FIG. 14, the structures common to FIGS. 5 and 14 are denoted by the same reference symbols as used above, and descriptions of such common structures are omitted.

A curved member 264 of the branching section 240 is inserted via a front end hole 263 in the right half 261, and a short pipe 266 is connected to a right connection hole 265 in the curved member 264 by welding. The first branch pipe 90 is inserted through a rear end hole 267 in the right half 261, and a front end 158 of the first branch pipe 90 is inserted into a right rear end hole 268 of the short pipe 266. The right half 261 is packed with a first sound absorbing material 174.

On the other hand, the second branch pipe 250 is inserted from the right end of the left half 262, and the rear end of the second branch pipe 250 is inserted into a rear end hole 269 in the left half 262. The left half 262 is filled with the first sound absorbing material 174. Incidentally, the second branch pipe 250 is a member in which a rectilinear portion 272 having a front-side left punching section 184 and a curved portion 273 having no punching section are united together.

The left end 275 of the right half 261 is inserted into a right end hole 274 of the left half 262, and the left rear end 277 of the branching section 240 is inserted to the front end 276 of the second branch pipe 250. The right half 261 and the left half 262 are coupled to each other by rivets 278.

A front end hole of the first inner pipe 110 is fitted over the rear end 279 of the first branch pipe 90, and a front end hole of a right front cover 271 is fitted over the front end of the first inner pipe 110. The front end 282 of the first inner pipe 110 and the front end 283 of the right front cover 271 are connected by welding. The right tube portion 139 is fitted to the right front cover 271, and the right front cover 271 and the right tube portion 139 are connected by bolts 138. The right front cover 271 and the right tube portion 139 are packed with a second right sound absorbing material 176. The right rear cover 141 is inserted into the right tube portion 139, and the right tube portion 139 and the right rear cover 141 are connected by welding.

On the other hand, a front end hole of the second inner pipe 120 is fitted over the rear end 284 of the second branch pipe 250, and a front end hole of a left front cover 281 is fitted over the front end of the second inner pipe 120. The front end 285 of the second inner pipe 120 and the front end 286 of the left front cover 281 are connected by welding. The left tube portion 143 is fitted to the left front over 281, and the left front cover 281 and the left tube portion 143 are connected by bolts 142. The left front cover 281 and the left tube portion 143 are packed with a second left sound absorbing material 178. The left rear cover 144 is inserted into the left tube portion 143, and the left tube portion 143 and the left rear cover 144 are connected by welding.

Operation of the exhaust system 40B as above will be described below.

In FIG. 14, an exhaust gas flows into the first branch pipe 90 as indicated by arrow (11), and then flows into the first sound absorbing material 174 through holes 189 in a front-side right punching section 183 as indicated by arrows (12). The acoustic energy of the exhaust is first absorbed by the first sound absorbing material 174.

Next, the exhaust gas flows into the first branch pipe 90 through the holes 189 as indicated by arrows (13). Further, the exhaust gas flows into the second right sound absorbing material 176 through holes 191 in a rear-side right punching section 185 as indicated by arrows (14). The acoustic energy of the exhaust is further absorbed by the second right sound absorbing material 176, so that exhaust noise is reduced. Subsequently, the exhaust gas flows through the holes 191 into the first inner pipe 110 as indicated by arrows (15), and is exhausted via a first exhaust port 177 as indicated by arrows (16).

On the other hand, when the exhaust gas flows via the branching section 240 into the second branch pipe 250 as indicated by arrow (17), the exhaust gas flows into the first sound absorbing material 174 through holes 208 in a front-side left punching section 184 as indicated by arrows (18). The acoustic energy of the exhaust is first absorbed by the first sound absorbing material 174.

Next, the exhaust gas flows through the holes 208 into the second branch pipe 250 as indicated by arrows (19). Further, the exhaust gas flows into a second left sound absorbing material 178 through holes 209 in a rear-side left punching section 187 as indicated by arrows (20). The acoustic energy of the exhaust is further absorbed by the second left sound absorbing material 178, so that exhaust noise is reduced. Subsequently, the exhaust gas flows through the holes 209 into the second inner pipe 120 as indicated by arrows (21), and is exhausted via a second exhaust port 179 as indicated by arrows (22).

Incidentally, while the exhaust system 40A (see FIG. 4), 40B (see FIG. 13) has been applied to the motorcycle in the embodiment, it can be applied also to three-wheel vehicles such as buggy, and may be applied to general vehicles.

In addition, while the exhaust pipe rear portion 81 (see FIGS. 4 and 13) has been disposed on the right side of the shock absorber 58 (see FIG. 4) in the embodiment, it may be disposed on the left side of the shock absorber.

Further, while the first branch pipe 90 (see FIGS. 4 and 13) has extended toward the vehicle body right side in the embodiment, it may extend toward the vehicle body left side by disposing the exhaust pipe rear portion 81 (see FIGS. 4 and 13) on the left side of the shock absorber 58 (see FIG. 4). In other words, the first inner pipe 110 (see FIGS. 4 and 13) may be disposed on the vehicle body left side.

Besides, while the second branch pipe 100 (see FIG. 4), 250 (see FIG. 13) has extended toward the vehicle body left side in the embodiment, it may extend toward the vehicle body right side through a space between the shock absorber 58 (see FIG. 4) and the rear wheel 21 (see FIGS. 4 and 13) by disposing the exhaust pipe rear portion 81 (see FIGS. 4 and 13) on the left side of the shock absorber. In other words, the second inner pipe 120 (see FIGS. 4 and 13) may be disposed on the vehicle body right side.

The motorcycle according to the present invention is suitable for application to an off road vehicle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust system adapted for use with a motorcycle comprising:

an engine supported on a vehicle body disposed between a front wheel and a rear wheel;

a swing arm which is provided on said vehicle body, extends rearward and turnably supports said rear wheel on a rear end thereof;

a seat disposed on the upper side of said rear wheel and supported by said vehicle body; and an exhaust pipe which extends from a cylinder head of said engine rearward on a first lateral side of said vehicle body and which, on a front side of said rear wheel, transverses from one of the lateral sides of said vehicle body to a second lateral side, with a transverse portion of said exhaust pipe passing between said swing arm and said seat, wherein a muffler having an outside diameter greater than an outside diameter of said exhaust pipe is disposed at said transverse portion of said exhaust pipe, and further comprising:

an inner pipe connected to a rear portion of said exhaust pipe and subjected to punching for permitting an exhaust gas to flow therethrough, wherein said muffler includes an outer tube covering said inner pipe and said rear portion of said exhaust pipe, and a sound absorbing material placed in said outer tube.

2. The exhaust system adapted for use with a motorcycle according to claim 1, wherein said vehicle body includes:

a head pipe, a main frame extending rearward from said head pipe, pivot plates extending downward from a rear end of said main frame, said swing arm swingably mounted on said pivot plate, seat rails disposed above a center point of swinging of said swing arm and supporting said seat, and a down tube extending downward from said head pipe and connected to said pivot plates;

an air cleaner is disposed in a space under said seat rail; and said muffler is disposed in a space defined by a rear part of a shock absorber by which said main frame and said swing arm are interconnected, a lower part of said air cleaner, and an upper part of said swing arm.

3. The exhaust system adapted for use with a motorcycle according to claim 2, wherein rear portions of said pivot plates and said seat rails are interconnected by left and right rear pipes disposed in a left-right pair in a vehicle width direction; and a heat shield panel which shields heat tending to be transferred from said muffler to said air cleaner is provided so as to extend between said rear pipes and to pass between said air cleaner and said muffler.

4. The exhaust system adapted for use with a motorcycle according to claim 3, wherein a mud guard is mounted on a lower side of said air cleaner so as to cover the rear side of said muffler, and ear sections covering said heat shield panel are provided at upper portions of said mud guard.

5. The exhaust system adapted for use with a motorcycle according to claim 3, wherein side portions of said vehicle body are covered with side covers, and a rear number plate is disposed on a rear lower side of said side covers and on a lateral side of said muffler; and between said side covers and said rear number plate a cavity section is formed which extends in a back-and-forth direction of said vehicle body along said rear pipe.

6. The exhaust system adapted for use with a motorcycle according to claim 5, wherein at a lower edge portion of said side cover a rib is provided which extends toward the inside of said vehicle body and constitutes a member defining said cavity section, said rib being formed so as to close a gap between said rear pipe and said lower edge portion of said side cover; and at least a part of said rib is cut out to provide a cutout section, whereby a rib-side cavity is formed between said rib and said rear pipe.

7. The exhaust system adapted for use with a motorcycle according to claim 5, wherein an upper edge portion of said rear number plate is a part defining said cavity section, and is located proximate to said rear pipe while entering into an inner side of said vehicle body than said lower edge portion of said side cover.

8. The exhaust system adapted for use with a motorcycle according to claim 1, wherein said exhaust pipe is branched at said rear portion thereof into a left part and a right part along a vehicle width direction on the rear side of a shock absorber provided on said vehicle body, and includes a first branch pipe extending to the first lateral side of said vehicle body, and a second branch pipe extending to the second lateral side of said vehicle body by passing between said shock absorber and a rear wheel connected to said shock absorber;

said inner pipe includes a first inner pipe connected to said first branch pipe, and a second inner pipe connected to said second branch pipe; and said outer tube is formed so as to integrally cover a part ranging from a front-side pipe portion disposed forwardly of a branching section of said exhaust pipe rear portion to said branching section, said first branch pipe and said first inner pipe, said second branch pipe and said second inner pipe, which are disposed rearwardly of said front-side pipe portion, in a U shape in plan view.

9. The exhaust system adapted for use with a motorcycle according to claim 8, wherein said second branch pipe and said second inner pipe are formed to be greater in diameter than said first branch pipe and said first inner pipe.

10. The exhaust system adapted for use with a motorcycle according to claim 8, wherein said first branch pipe and said first inner pipe are gradually decreased in diameter as a first exhaust port forming a rear end of said first inner pipe is approached, and said second branch pipe and said second inner pipe are gradually decreased in diameter as a second exhaust port forming a rear end of said second inner pipe is approached.

11. The exhaust system adapted for use with a motorcycle according to claim 8, wherein said first branch pipe and said second branch pipe are each bent in an S shape in side view and then obliquely extended rearwardly upward.

12. The exhaust system adapted for use with a motorcycle according to claim 8, wherein front-side punching sections permitting the exhaust gas to pass therethrough are added to a rectilinear portion of said first branch pipe and a rectilinear portion of said second branch pipe, whereas said front-side punching sections are not added to either a curved portion of said first branch pipe or a curved portion of said second branch pipe.

13. The exhaust system adapted for use with a motorcycle according to claims 12, wherein rear-side punching sections located rearwardly of said front-side punching sections and permitting the exhaust gas to pass therethrough are added to said first inner pipe and said second inner pipe, and a hole diameter in said front-side punching section is smaller than a hole diameter in said rear-side punching section.

14. The exhaust system adapted for use with a motorcycle according to claim 8, wherein said outer tube includes a first outer cylinder by which said front-side pipe portion and said branching section and said first branch pipe and said second branch pipe are covered, and a pair of left and right second outer tubes which are detachably attached to said first outer tube and by which said first inner pipe and said second inner pipe are covered, and said first outer tube is provided thereon with a maintenance lid which covers said front-side punching section disposed at said rectilinear portion of said second branch pipe.

15. The exhaust system adapted for use with a motorcycle according to claim 14, wherein said first outer tube is formed in a flat shape in side view, and an upper surface portion and a lower surface portion of said first outer tube are formed to be inclined rearwardly upward.

16. An exhaust system adapted for use with a motorcycle with an engine supported on a vehicle body disposed between a front wheel and a rear wheel, a swing arm which is provided on said vehicle body, extends rearward and turnably supports said rear wheel on a rear end thereof, a seat disposed on the upper side of said rear wheel and supported by said vehicle body, the exhaust system comprising:

an exhaust pipe which extends from a cylinder head of said engine rearward on a first lateral side of said vehicle body and which, on a front side of said rear wheel, transverses from one of the lateral sides of said vehicle body to a second lateral side, with a transverse portion of said exhaust pipe passing between said swing arm and said seat, wherein a muffler having an outside diameter greater than an outside diameter of said exhaust pipe is disposed at said transverse portion of said exhaust pipe, wherein the transverse portion is provided with a maintenance lid on an upper facing side thereof, and further comprising:

an inner pipe connected to a rear portion of said exhaust pipe and subjected to punching for permitting an exhaust gas to flow therethrough, wherein said muffler includes an outer tube covering said inner pipe and said rear portion of said exhaust pipe, and a sound absorbing material placed in said outer tube.

17. The exhaust system adapted for use with a motorcycle according to claim 16, wherein said exhaust pipe is branched at said rear portion thereof into a left part and a right part along a vehicle width direction on the rear side of a shock absorber provided on said vehicle body, and includes a first branch pipe extending to the first lateral side of said vehicle body, and a second branch pipe extending to the second lateral side of said vehicle body by passing between said shock absorber and a rear wheel connected to said shock absorber;

said inner pipe includes a first inner pipe connected to said first branch pipe, and a second inner pipe connected to said second branch pipe; and said outer tube is formed so as to integrally cover a part ranging from a front-side pipe portion disposed forwardly of a branching section of said exhaust pipe rear portion to said branching section, said first branch pipe and said first inner pipe, said second branch pipe and said second inner pipe, which are disposed rearwardly of said front-side pipe portion, in a U shape in plan view.

18. The exhaust system adapted for use with a motorcycle according to claim 16, wherein said vehicle body includes:

a head pipe, a main frame extending rearward from said head pipe, pivot plates extending downward from a rear end of said main frame, said swing arm swingably mounted on said pivot plate, seat rails disposed above a center point of swinging of said swing arm and supporting said seat, and a down tube extending downward from said head pipe and connected to said pivot plates;

an air cleaner is disposed in a space under said seat rail; and said muffler is disposed in a space defined by a rear part of a shock absorber by which said main frame and said swing arm are interconnected, a lower part of said air cleaner, and an upper part of said swing arm.

19. The exhaust system adapted for use with a motorcycle according to claim 18, wherein rear portions of said pivot plates and said seat rails are interconnected by left and right rear pipes disposed in a left-right pair in a vehicle width direction; and a heat shield panel which shields heat tending to be transferred from said muffler to said air cleaner is provided so as to extend between said rear pipes and to pass between said air cleaner and said muffler.

20. The exhaust system adapted for use with a motorcycle according to claim 19, wherein side portions of said vehicle body are covered with side covers, and a rear number plate is disposed on a rear lower side of said side covers and on a lateral side of said muffler; and between said side covers and said rear number plate a cavity section is formed which extends in a back-and-forth direction of said vehicle body along said rear pipe.

* * * * *